US012595651B2

(12) United States Patent
Snorrason

(10) Patent No.: US 12,595,651 B2
(45) Date of Patent: Apr. 7, 2026

(54) SYSTEM FOR ARCHITECTURAL MODULAR BUILDING CONSTRUCTION

(71) Applicant: CUBIT BUILDING COMPANY EHF, Reykjavik (IS)

(72) Inventor: Adalsteinn Snorrason, Reykjavik (IS)

(73) Assignee: CUBIT BUILDING COMPANY EHF, Reykjavik (IS)

( * ) Notice: Subject to any disclaimer, the term of this patent is extended or adjusted under 35 U.S.C. 154(b) by 19 days.

(21) Appl. No.: 17/906,510

(22) PCT Filed: Feb. 11, 2021

(86) PCT No.: PCT/IS2021/050002
§ 371 (c)(1),
(2) Date: Sep. 16, 2022

(87) PCT Pub. No.: WO2021/186481
PCT Pub. Date: Sep. 23, 2021

(65) Prior Publication Data

US 2023/0145279 A1 May 11, 2023

(30) Foreign Application Priority Data

Mar. 16, 2020 (IS) ..... 050295

(51) Int. Cl.
*E04B 1/348* (2006.01)

(52) U.S. Cl.
CPC ..... *E04B 1/3483* (2013.01); *E04B 1/34861* (2013.01)

(58) Field of Classification Search
CPC ..... E04B 1/3483; E04B 1/34861
USPC ..... 52/79.1
See application file for complete search history.

(56) References Cited

U.S. PATENT DOCUMENTS 1,813,909 A * 7/1931 Brainard ..... E04C 2/384 52/282.4
2,255,194 A * 9/1941 Stout ..... E04B 1/24 52/656.1
2,724,465 A * 11/1955 Krauss ..... E04B 2/96 52/407.3

(Continued)

FOREIGN PATENT DOCUMENTS

DE 202019104087 U1 8/2019
EP 2226441 A1 9/2010

(Continued)

OTHER PUBLICATIONS

International Search Report and Written Opinion of International Application No. PCT/IS2021/050002 mailed May 4, 2021, 10 pages.

(Continued)

*Primary Examiner* — James M Ference
(74) *Attorney, Agent, or Firm* — HESLIN ROTHENBERG FARLEY & MESITI P.C.

(57) ABSTRACT

Disclosed is a building module for use in modular building assemblies. The building module has frame comprising one or more parallelepiped unit cells and connection nodes at the corner of the unit cells, so that building modules can be connected together in a modular fashion using the connection nodes. Also disclosed is a system for building construction that comprises such building modules, and habitable modular buildings that comprises the building modules.

10 Claims, 21 Drawing Sheets

(56) References Cited

U.S. PATENT DOCUMENTS 3,110,131 A * 11/1963 Jeffress ..... E04C 2/044 52/762
3,229,431 A * 1/1966 Paul ..... E04B 1/3483 D25/4
3,245,183 A * 4/1966 Tessin, II ..... E04H 1/005 52/282.5
3,292,327 A * 12/1966 Van Der Lely ..... E04B 1/34823 425/117
3,500,595 A * 3/1970 Bennett ..... E04B 1/3483 D25/123
3,568,380 A * 3/1971 Stucky ..... E04B 1/34815 52/223.13
3,605,350 A * 9/1971 Bowers ..... E04B 1/3483 D25/1
3,685,228 A * 8/1972 Pauley ..... E04B 2/94 52/235
3,755,974 A * 9/1973 Berman ..... E04B 1/34869 52/73
3,881,571 A * 5/1975 Moulton ..... E04G 1/14 182/178.5
3,900,994 A * 8/1975 Van der Lely ..... E04H 1/04 52/72
3,971,172 A * 7/1976 Gentil ..... E04B 1/24 52/28
3,998,016 A * 12/1976 Ting ..... E04B 1/98 52/235
4,012,871 A * 3/1977 Netto ..... E04B 1/34861 D25/4
4,050,215 A * 9/1977 Fisher ..... E04B 1/34815 D25/1
4,077,170 A * 3/1978 van der Lely ..... E04B 1/34853 52/263
4,077,171 A * 3/1978 Simpson ..... E04D 13/151 52/96
4,106,243 A * 8/1978 Horn ..... E04B 1/3483 52/16
4,124,964 A * 11/1978 Juriss ..... E04H 1/005 52/79.8
4,126,972 A * 11/1978 Silen ..... E04H 9/14 52/166
4,221,099 A * 9/1980 Caserta ..... E04B 1/34823 52/79.11
4,287,695 A * 9/1981 Hofler ..... E04B 2/58 52/241
4,299,065 A * 11/1981 Fairgrieve ..... E04B 1/3483 52/79.11
4,435,927 A * 3/1984 Umezu ..... E04B 1/3483 52/235
4,443,992 A * 4/1984 Shechter ..... E04B 1/3483 52/506.05
4,599,829 A * 7/1986 DiMartino, Sr. ..... E04B 1/3483 52/106
4,644,708 A * 2/1987 Baudot ..... E04B 1/3483 52/79.9
4,782,637 A * 11/1988 Eriksson ..... E04B 1/3483 312/263
4,833,841 A * 5/1989 Ellington, III ..... E04B 1/3483 52/690
4,858,398 A * 8/1989 Ricchini ..... E04B 1/34315 52/584.1
4,910,932 A * 3/1990 Honigman ..... E04B 1/08 52/282.4
4,974,386 A * 12/1990 Eriksson ..... E04H 1/1238 312/111
5,044,134 A * 9/1991 Brockway ..... E04B 1/0007 52/79.9
5,195,282 A * 3/1993 Campbell ..... E04B 1/28 52/280
5,289,665 A * 3/1994 Higgins ..... E04B 5/43 52/655.1
5,317,857 A * 6/1994 Allison ..... E04H 1/1205 52/DIG. 9
6,925,761 B1 * 8/2005 De La Marche ... E04B 1/34815 52/234
8,763,314 B2 * 7/2014 Yoo ..... E04H 1/1272 52/79.2
9,441,359 B1 * 9/2016 Hsieh ..... E04B 1/3483
10,011,982 B1 * 7/2018 Baker ..... G06Q 50/16
10,344,436 B2 * 7/2019 Guven ..... E01D 15/124
10,364,572 B2 * 7/2019 Collins ..... E04C 2/34
10,544,584 B2 * 1/2020 Cecchetto, Jr. ..... E04B 2/885
2003/0000155 A1 * 1/2003 Zwerenz ..... A63H 33/10 446/124
2004/0040223 A1 * 3/2004 De La Marche ..... E04G 21/142 52/79.9
2005/0210762 A1 * 9/2005 Broberg ..... E04C 3/32 52/79.9
2005/0241242 A1 * 11/2005 De La Marche ... E04B 1/34815 52/79.1
2005/0262778 A1 * 12/2005 Allen ..... E04H 1/04 52/79.1
2007/0245638 A1 * 10/2007 Lai ..... E04H 1/125 52/79.1
2007/0271857 A1 * 11/2007 Heather ..... B65D 90/006 52/79.9
2008/0066422 A1 * 3/2008 Huxel ..... E04B 1/3483 52/506.01
2009/0019811 A1 * 1/2009 Goldman ..... E04B 1/34807 52/741.1
2009/0223161 A1 * 9/2009 Segall ..... E04B 1/61 52/749.1
2009/0307994 A1 * 12/2009 Cathcart ..... E04C 2/246 52/794.1
2011/0173907 A1 * 7/2011 Katsalidis ..... E04C 3/30 52/741.1
2011/0179721 A1 * 7/2011 Barry ..... E04H 1/005 52/745.02
2011/0214361 A1 * 9/2011 Ingjaldsdottir ..... E04B 1/34869 52/745.13
2012/0102871 A1 * 5/2012 Randall ..... E04B 1/34321 52/745.13
2013/0180182 A1 * 7/2013 Yoo ..... G09F 15/0068 52/27
2013/0239487 A1 * 9/2013 Ingjaldsdottir ..... E04B 2/30 52/79.1
2014/0059947 A1 * 3/2014 Rothwell ..... E04B 1/343 52/79.5
2015/0159363 A1 * 6/2015 Ehsasi ..... E04H 1/1205 52/79.5
2016/0319534 A1 * 11/2016 Bernardo ..... E04B 1/34807
2017/0044753 A1 * 2/2017 Bowron ..... E04B 1/34384
2019/0186122 A1 * 6/2019 Patterson ..... E04B 1/10
2019/0211544 A1 * 7/2019 Argyrou ..... E04G 11/56
2023/0145279 A1 * 5/2023 Snorrason ..... E04B 1/34861 52/79.1

FOREIGN PATENT DOCUMENTS

EP 2535471 A1 12/2012
EP 3070216 A1 9/2016
WO 2014008551 A1 1/2014
WO 2014009799 A1 1/2014
WO 2016050212 A1 4/2016

OTHER PUBLICATIONS

Danish Patent and Trademark Office Search Report of International Application No. PCT/IS2021/050002, 2 pages.

* cited by examiner

SYSTEM FOR ARCHITECTURAL MODULAR BUILDING CONSTRUCTION

CROSS REFERENCE TO RELATED APPLICATIONS

This application is a U.S. National Phase filing under 35 U.S.C. § 371 of International Application PCT/IS2021/050002, filed Feb. 11, 2021, and published as WO 2021/186481 A1 on Sep. 23, 2021. PCT/IS2021/050002 claims priority from Iceland application number 050295, filed Mar. 16, 2020. The entire contents of each of these prior applications are hereby incorporated herein by reference.

FIELD

The invention relates to building modules, in particular building modules that can be assembled into modular building assemblies. The invention also relates to building construction using prefabricated building modules.

INTRODUCTION

The building of structures for human habitation or use has traditionally been executed on the site of the intended structure, with the building materials being transported to the site in various states of preparation for their intended function and then further prepared and sequentially installed in the structure until the finish of the building period and commissioning of the building for its intended use. During the life of such a building it will need maintenance and may be subject to renovation, but in most cases the building and its constituent materials will stay at the initial location until it is dismantled.

More recently buildings have been constructed in a modular fashion where the modules are prefabricated away from the building site and then transported to and erected on the building site. The "modular building" industry which constitutes prior art falls into three main categories. In the first category there are manufacturers who present and provide a select few house designs which are then manufactured in parts (modules) appropriately sized for transport, which are then erected and assembled on the building site, where after the building will stay during its lifetime. The modules can be both planar i.e. panels or pre-cast elements to be joined on site or volumetric units that form enclosed spaces within a completed building and are assembled on the building site. Generally, such buildings are not fit for disassembly and reassembly at another location. The modular units are not intended for assembly in a manner different from their initial location in the house design plan. This approach to the prefabrication of buildings can be described as "house part prefabrication". Its advantage derives from the production of somewhat standardized house parts in a controlled environment. In the second category are buildings designed in the conventional manner but manufactured in a factory setting in units suitable for transport and assembly on the building site. The building units will be non-standard and specific to the project. As with the first category the advantages of this building method derive from the production of building parts in a controlled environment, possibly in a low wage area. Product standardization is not an important aspect of the advantages of this category. In the third category there is the manufacture of prefabricated building modules which conform to the ISO cargo container exterior dimensions that are transported to the building site and assembled there in a predetermined configuration. While this increases the transport possibilities of the building modules, it hinders the erection of buildings which satisfy the full demands of human habitation or use. The reasons are the height constraints on the ISO cargo containers. Their standard exterior heights are 2,438 mm (8') or 2,591 mm (8'-6"), but so called high cube containers with exterior heights of 2,896 mm (9'-6") are also available. The minimum ceiling height of buildings varies between locations, but the International Building Code, which is widely adopted for use as a base code in the United States, stipulates that commercial buildings and any building containing more than two dwelling units must have a minimum ceiling height of 2,286 mm (7' 6"). However, the common ceiling heights of residential and commercial buildings have in previous decades increased from 2,438 mm (8') to 2,743 mm (9') according to data from the National Association of Home Builders in the USA. In Europe the expected and building code stipulated ceiling height is often 2,500 mm. Since the full building module height must include the thickness of floor slabs and flooring material, the thicknesses of bottom and top cladding as well as service systems such as plumbing and air handling ducts it is evident that it is difficult to accommodate a reasonably sized building module within the constraints of the ISO cargo container dimensions.

The concept of modularity is also partly limited when adhering to the ISO cargo container size standard. The ISO standard width is 2438 mm or 8'. The ISO standard lengths in feet are 5', 6½; 10', 20', 30', 40' and 45'. None of these standard lengths, except for the 40' length, are integer multiples of the standard width. When building modules adhering to the ISO size range are arranged contiguously such that one is rotated by 90° with respect to the other modules, which are arranged side by side lengthwise along the rotated module such that their ends adjoin the rotated module, of necessity there will be a mismatch between the length of the rotated module and the combined widths of the other modules, the exception being five modules arranged lengthwise along a 40' module. This limits the modularity of the ISO cargo container size standard approach.

The reliance of prior art on ISO standards of corner node locations and their spacing precludes the connection of building units arranged at right angles to each other. Since the spacing of the attachment points is not equal in the longitudinal and transverse directions, the only way to arrange the modules is by parallel arrangements where the longitudinal axes of the building units all point in the same direction. This severely constrains the modularity of the ISO cargo container size approach to building construction.

Therefore, and in summary, the prior art does not incorporate true modularity of building construction. Either the building modules are destined for a certain location in the finished building or the size constraints of the building modules make the construction of buildings with acceptable ceiling heights impractical. The flexibility of the ISO cargo container size approach to modular building may also be called into question.

SUMMARY

The present invention relates to the field of building construction, in particular to the construction of buildings from individually transportable units, herein referred to as building modules, conforming to a modular system. The physical dimensions of the building modules are standardized in such a way that their length is an integer multiple of their width (i.e., the length $L=n\times A$, where L is the length and A the width of the building module, and n is any non-zero integer). The building modules can be arranged and connected in a multitude of ways using connection means disposed at regular intervals within the modules, allowing for the construction of buildings of a wide range of architectural designs.

In an aspect, the invention relates to a building module. The building module comprises a frame comprising one or more unit cell, wherein each unit cell has a rectangular parallelepiped, structure with equal length and width, the frame having four upright corner columns and beams disposed at, or near, upper and lower ends of each of the corner columns to connect adjacent corner columns in the frame and thereby define four rectangular parallelograms at each side of the building module. A first pair of the resulting parallelograms are parallel and a second pair of parallelograms are also parallel and orthogonal to said first pair. The building module further comprises plurality of connection nodes, the connection nodes being disposed on the frame at positions corresponding to corners of the one or more unit cell within the frame, the connection nodes being adapted for selective, reversible connection to connection nodes on adjacent building modules in an assembly of building modules. As a result of the building module design, the module is connectable to at least one further building module, by allowing connection nodes of at least one unit cell of the building module to engage connection nodes of at least one unit cell on the at least one further building module.

At least one further building module preferably comprises unit cells that have identical dimensions as the unit cells of the building module to which the further building module is to be connected. The connection nodes are preferably provided at all eight corners of a unit cell, i.e. at four upper corners and at four lower corners. Further, the connection nodes on the building modules are preferably arranged in an identical fashion, so that when two or more building modules are assembled, connection nodes on one building module meet connection nodes on an adjacent building module. As a result, the building modules represent basic building blocks that can be assembled in a multitude of geometrical manners to generate building constructs of various sizes and shapes.

The building module has a length that is anon-zero integer multiple of its width. The modularity of each building module and fixed dimensions of the unit cells that each building module is comprised of means that connection nodes on adjacent building modules will line up, for easy modular construction of buildings using a plurality of building modules that can be assembled in any orientation (e.g. end-on, side-by-side or end-to-side).

The corner columns and beams connecting the corner columns (at least four beams connecting at or near the upper ends of the corner columns, and at least four additional beams connecting at or near the lower ends of the corner columns) form the frame of the building module. In general the beams and corner columns can be provided by any suitable structural solutions known in the art. The beams can for example be provided as load-bearing beams, such as I-beams, L-beams (also referred to as L-angles), C-beams, U-beams (U-angles) or tubes. The beams can also be provided as an assembly of two or more types of beams to generate a building module with desired load-bearing capabilities. The corner columns can suitably be provided as L-angles, tubes or bars.

The beams are arranged laterally, i.e. parallel to ground and preferably so that beams that connect four upright corner columns of a building module define a plane that is parallel to ground. There can be a first set of beams that are connected to, or near to, upper corners of the building module, and a second set of beams that are connected to, or near to, lower corners of the building module. The two sets of beams thereby define two parallel planes that are both parallel to ground.

The term "rectangular parallelepiped", sometimes also called "rectangular cuboid" or "orthogonal parallelepiped", refers to a rectangular polyhedron in which each of the faces is a rectangle, and all angles are 90°.

The term "connection node" in the present context refers to a location or position on a building module that comprises means for engaging two or more adjacent modules. A connection node thus is a location that contains means for allowing adjacent building modules to be attached. Such attachment can include securing means, such as connectors (e.g., bolts), that engage adjacent building modules at connection nodes.

At each connection node there can be provided one or more connection points, each of which provides means for securing a building module to a further building module in an assembly of building modules.

It can be preferable to connect at least some beams at a distance from the upper and lower ends of the corner columns. When so designed, connection means (through connection points) are provided at or near the upper and lower ends of the corner columns, above and/or below the respective beams. Such a design facilitates the assembly of building modules to generate a building assembly, since the connection nodes can then be reached from above and/or below the building module, without floor and ceiling impeding such access.

When so provided, at least one beam can be provided at a distance that is less than about 200 mm, less than about 150 mm or less than about 100 mm from the upper and/or lower end of the corner columns.

The building modules can comprise load bearing beams (for receiving floor and/or ceiling load) that connect to the upright corner columns, thereby defining two sets of planes that are both parallel to ground. The load-bearing beams can have holes or apertures, one or more, that extend through the beams. By providing such apertures, it is possible to provide means for extending service components (wires, cables, pipes and the like) between adjacent building modules. The holes or apertures can preferably be arranged identically on the building modules so that when two or more building modules are connected, the holes or apertures in beams on a first building module line up with holes or apertures on second building module(s) that are connected to the first building module. Thereby, the building modules can be assembled in any fashion, i.e. side-by-side, end-to-side or end-to-end, so that holes in load-bearing beams on adjacent building modules line up.

There can be additional columns provided in the building modules to provide further structural integrity to the modules. Preferably such additional columns are provided at positions corresponding to the location of connection nodes. This means that additional vertical columns (support columns) can be provided to connect two vertically aligned connection nodes along the sides of the building modules (e.g., longitudinal sides of the building modules). Such support columns can be provided as a single column (e.g., single L-shaped or U-shaped angle) or as a pair of such columns, arranged in a parallel fashion, with both columns connected to respective connection nodes on the building module.

The building modules can have floor and/or ceiling panels. Such floor and ceiling panels can be connected to the load-hearing beams, or to additional beams such as load-hearing angles that are laterally connected to, or laterally disposed on, the load-bearing beams. The floor and ceiling panels can be provided as modular units that have the same dimensions as the unit cell (width and length). Thereby, the floor and ceiling panels can be connected to the frame at connection nodes on the frame, using connection points (suitably provided by holes through the beams, or angles connected to the beams).

The building modules can also be provided with exterior wall units, composed of wall panels which can be modified to include various modalities, including windows and doors. The exterior wall units can suitably be provided in a modular manner, for example so that each has a width that corresponds to the dimensions of the unit cell, and a height that corresponds to the height of the unit cell. Again, the advantage of such a design is that exterior wall units can be used with any building module having the same unit cell dimensions as the exterior wall unit. Thereby, a variety of exterior wall units can be integrated into building modules to produce a library or building modules for providing a large variety of functionally and structurally different building assemblies.

To the outside of the exterior wall units can be attached building units conforming to the modular system, such as vertical and lateral rails and cladding, with insulation units being provided between the exterior wall units and cladding. To the inside of the exterior wall units can be attached battens which support interior wall panels (51) which are the visible surface of the exterior wall. The cavity provided by the battens allow for the concealing of plumbing and electric wiring. The building modules can in principle be provided in any suitable size. It can however be particularly advantageous to produce the building modules so that they correspond to allowable sizes for transportation by e.g. trucks or ships.

In some embodiments, each unit cell of the building modules has a length and width that is in the range of about 2200-about 3000 mm, such as about 2300-about 2800 mm, such as about 2400-about 2700 min, such as about 2500 to about 2600 mm. It can be preferable that the unit cells have dimensions of about 2550 mm (width and length).

The height of the unit cell can be in the range of about 2800-about 4000 mm, such as in the range of about 3000-about 3800 mm, such as in the range of about 3200-about 3600 mm, in the range of about 3300-about 3400 mm. In some embodiments, the height is about 3350 mm.

The building modules can in general comprise any numer of unit cells. When the building modules comprise a linear arrangement of unit cells, their dimension can be formulated as length=n×A, where A is the width of the unit cell (equal to the width of the building module). It can be preferable that the building modules comprise one to five unit cells, arranged end-on in a linear fashion. Representative examples of building modules comprise one, two, three, four or five unit cells, arranged in a linear fashion.

The building modules can be assembled to produce buildings in the form of building assemblies comprising a plurality (two or more) of building modules. Such building assemblies can comprise any building modules as described herein.

Building modules can be connected using connection points that are located at regular intervals on the frame, i.e. at the connection nodes. Each connection node can comprise one or more connection points. The intervals therefore correspond to the dimensions of the unit cell, in particular its width.

In the building assemblies, the building modules are connected together by means of connectors, using connecting points provided at the connection nodes of the building modules. By virtue of the design of the building modules, the connection nodes of two adjacent building modules meet. Thereby, it becomes possible to connect the building modules using conventional connecting means known in the art, taking advantage of connecting points on each building module. Thus, the building assembly comprises connectors that are adapted to engage, via connection points, adjacent connection nodes in the building assembly. Thereby, the individual adjacent building modules are securely, yet reversibly, connected together.

The building modules can also be assembled vertically, i.e. the modules can be stacked on top of each other. Again, by virtue of the modular design, connection nodes of adjacent building modules in a stack meet (e.g., four corner columns, or corner columns and support columns), and can be secured together using connectors and connection points on the individual building modules.

The building assemblies can further comprise roof units. These can be of any particular suitable design, e.g. flat or sloping. The roof units can preferably be modular, e.g. conforming to the unit cell dimensions of the building modules.

The building assemblies can furthermore include means for securing the building assembly to the ground. This can be provided by means of a plurality of support foundations to which the building modules are secured during the assembly, using connecting means disposed for example at connecting nodes on the building modules.

Also provided is a system for constructing modular buildings, using a plurality of building modules as described herein, i.e. interconnectable building modules having a modular design and connectors for assemblying the building modules. The system can also comprise additional components, such as roof units, ground securing units, external wall panels, internal walls, as well as necessary service components, e.g. electrical wires or cables, water/sanity piping, air ducts and the like.

The invention can additionally be described the following non-limiting embodiments:

Building Module Embodiments:

M1. A building module, comprising:

a frame comprising one or more unit cell, wherein each unit cell has a rectangular parallelepiped structure with equal length and width, the frame having four upright corner columns and beams disposed at, or near, upper and lower ends of each of the corner columns to connect adjacent corner columns in the frame and thereby define four rectangular parallelograms, one at each side of the building module, a first pair of said parallelograms being parallel and a second pair of parallelograms being parallel and orthogonal to said first pair;

a plurality of connection nodes, the connection nodes being disposed on the frame at positions corresponding to corners of the one or more unit cell within the frame, the connection nodes being adapted for selective, reversible connection to connection nodes on adjacent building modules in an assembly of building modules;

whereby the building module is connectable to at least one further building module, by allowing connection nodes of at least one unit cell of the building module to engage connection nodes of at least one unit cell on the at least one further building module.

M2. The building module of the previous embodiment, wherein the building module comprises a plurality of unit cells arranged end-on, so that the length of the building module is an integer multiple of its width.

M3. The building module of any one of the preceding embodiments, wherein the rails comprise one or more of: I-beam, L-beam, L-angle, tube, bar.

M4. The building module of any one of the preceding embodiments, wherein the corner columns are connected by load-bearing beams that are connected to the corner columns at, or near, upper and lower corners of the building module to define upper beams and lower beam, so that such upper beams define a first plane, horizontal to ground, and lower such beams define a second plane, parallel to the first plane.

M5. The building module of the preceding embodiment, wherein the load-bearing beams comprise at least one aperture thereon that is disposed symmetrically within each unit cell, so that when building modules are adjacently placed, the at least one aperture within a first building module is aligned with at least one aperture on an adjacent building module, thereby allowing side-by-side, end-to-end and end-to-side connection of building modules so that when two or more building modules are connected, apertures on one building module are aligned with apertures on adjacent building modules.

M6. The building module of any one of the preceding two embodiments, wherein the load-bearing beams are adapted to receive floor and ceiling loads, respectively.

M7. The building module of any one of the preceding embodiments, wherein the building module further comprises load-bearing angles that are connected to the rails and/or load-bearing beams and thereby provide additional load bearing to the building module.

M8. The building module of the preceding embodiment, wherein the load-bearing angles are arranged laterally on lateral beams connecting opposite cornercolumns.

M9. The building module of any one of the preceding embodiments, further comprising one or more of internal and/or external wall panels that are connected to the frame.

M10. The building module of the preceding embodiment, comprising internal and external wall panels, wherein insulation is disposed between the internal and external wall panels.

M11. The building module of any one of the preceding embodiments, further comprising one or more of floor and ceiling panels, preferably so that the load of said one or more floor and ceiling panels is transferred to the load-bearing beams.

M12. The building module of any one of the preceding embodiments, further comprising one or more vertical support columns connecting two or more vertically aligned connection nodes, wherein the support columns are disposed in between corner columns of the building module.

M13. The building module of any one of the preceding embodiments, further comprising at least one cross-beam, extending from an upper corner, or close to an upper corner, on a first corner column of the building module to a lower corner, or close to a lower corner, on an adjacent second corner column.

M14. The building module of any one of the preceding embodiments, wherein the building module has dimensions that are not limited to ISO freight container exterior dimensions.

M15. The building module of any one of the preceding embodiments, wherein each unit cell has equal length and width that is in the range of 2400 mm to 2700 mm, preferably in the range of 2500 mm to 2600 mm, more preferably about 2550 mm.

M16. The building module of any one of the preceding embodiments, wherein each unit cell has a height that is in the range of 2800 mm to 4000 mm, preferably in the range of 3000 mm to 3800 mm, more preferably in the range of 3200 mm to 3600 mm, even more preferably in the range of 3300 mm to 3400 mm, still more preferably about 3350 mm.

M17. The building module of any one of the preceding embodiments, wherein the building module comprises from one to five unit cells arranged end-on, preferably from one to four unit cells, more preferably from one to three unit cells.

M18. The building module of any one of the preceding embodiments, further comprising one or more connectors disposed on the frame between adjacent connection nodes, for supplementary connection of adjacent building modules in an assembly of building modules.

M19. The building module of the previous embodiments, wherein the one or more connector is disposed to engage two adjacent connection nodes on adjacent building modules.

System Embodiments

S1. A system for the construction of a building assembly, the system comprising a plurality of interconnectable building modules, wherein each building module comprises a frame comprising one or more unit cell having a rectangular parallelepiped structure with equal length and width, such that the length of the frame is an integer of its width, wherein each building module further comprises a plurality of connection nodes that are disposed so that connection nodes of a first building module are adapted to meet connection nodes of an adjacent building module in the system of building modules, the system further comprising a plurality of connectors that are adapted to engage adjacent connection nodes in an assembly of adjacent building modules so that adjacent building modules can be securely and reversibly connected.

S2. The system of the previous embodiment, wherein the building modules comprise a plurality of structural members for carrying vertical loads and wherein optionally at least one of the building modules comprises structural members for carrying lateral loads.

Modular Building Assembly Embodiments:

A1. A modular building assembly, comprising two or more prefabricated interconnected building modules, in particular building modules according to any one of building module embodiments M1-M19, wherein adjacent building modules in the building assembly are interconnected in tandem, orthogonally or vertically, so that at least one unit cell in a first building module is interconnected with a building cell in an adjacent second building module.

A2. The modular building assembly of the preceding embodiment A1, further comprising a modular roof unit, wherein the modular roof unit is adapted for connection to connection nodes in the assembly of building modules.

A3. The modular building assembly of any one of the preceding embodiments, the assembly further comprising a support foundation, for providing ground support for the building assembly.

A4. The modular building assembly of the preceding embodiments, wherein the support foundation comprises a plurality of foundation elements, wherein each such foundation element comprises at least one connector, for connecting and securing the modular building to the foundation element.

A5. A habitable modular building, the building comprising a modular building assembly according to any one of the embodiments A1-A4, the habitable modular building further comprising at least one of: electrical cabling, information signal cabling, water piping, water and/or sanitary draining pipes and air handling ducts.

A6. The habitable modular building of the previous embodiment, further comprising at least one window unit and at least one door unit, the window and door units being disposed in at least one wall panel in said modular building assembly.

The above features along with additional details of the invention, are described further in the examples below, which are intended to further illustrate the invention but are not intended to limit its scope in any way.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

Figure 1:
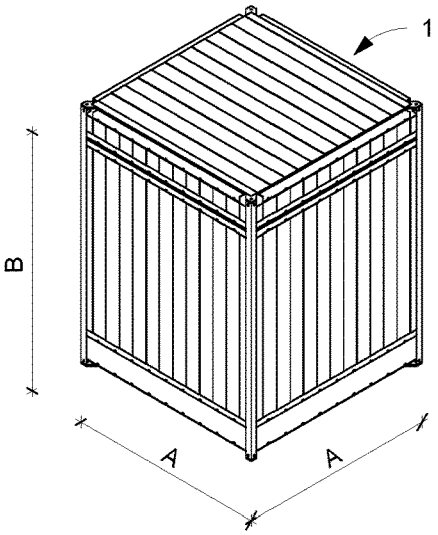
FIG. 1: building module M1—is an isometric view of building module M1 which has the voltunetric size of one unit cell.

In the following, exemplary embodiments of the invention will be described, referring to the figures. These examples are provided to provide further understanding of the invention, without limiting its scope.

The present invention relates to a modular building system, also called "Architectural Modular Building System" comprising building modules that can be interconnected in various ways to produce a desired building configuration. The building modules can be prefabricated, allowing rapid and easy assembly on a building site. The building modules can also be reused, by disassembly of a modular building, partially or completely, and thereby removing one or more building module.

The building system is based on the concept of designing individual building modules as a plurality of unit cells. Each unit cell has a parallelepiped structure, with equal width and length. The smallest building module contains a single unit cell, but any desired number of unit cells can be used to define building modules of various sizes, i.e. the building modules can consist of any number of unit cells. Individual building modules can therefore have a length that is an integral number of their width, i.e. L=n×A, where L is the length of a building module, A is its width and n represents the number of unit cells in each building module. By definition, each unit cell has dimensions L=A. The height of the unit cell is set to a fixed value B, which is typically common to all building modules in a building assembly.

Conventional containers have been adapted to be used as basic construction units in modular building assemblies. Such constructions are limited by the geometric and spatial limitations of containers. First and foremost, the length of conventional containers is not a multiple of its width. For example, a typical shipping container has a width of 2.4 m (8 ft) and a length of 6.1 m (20 ft). This means that there are significant limitation on how multiple containers can be connected, due to the lack of symmetry. By way of example, two containers can be connected end-on with the side of a third container. But, such a construction leaves a gap of 1.3 m (the difference between 6.1 m and 2×2.4 m). Adding a third container leaves an overhang of 1.1 m (the difference between 3×2.4 m and 6.1 m). In either case, the space that is generated by the unequal dimensions needs to be filled, if the overall construction is intended to have a rectangular shape. This puts severe practical limitations on the housing that can be constructed using containers, and the modularity of building modules is severly limited. This also leads to increased construction costs, since each building construction needs to be adapted based on the intended geometrical shape and gaps/overhangs generated by the assembly of building modules filled in or removed.

By contrast, the building modules of the present invention have dimensions such that each building module has a length that is an integer of its width. Each building module is constructed of one or more unit cell that has equal length and width. The smallest building module consists of one unit cell, and therefore has equal length and width. The second smallest consists of two unit cells, having a length that is twice its width, and so on.

This way, any combination of building modules is possible, i.e. end-on or end-to-side, leaving no gaps or overhangs. This is a vast improvement over prior art solutions, since the consequence of this constructions is that building modules can be mass produced in a stand-alone construction format, and assembled and re-assembled as needed on site. This type of construction is not possible using container solutions described in the art.

Moreover, the symmetrical construction, including the symmetry of apertures in the load-bearing beams means that the openings in load-bearing beams of one building module will line up with load-hearing beams of other building modules when two or more building modules are placed side-by side, independent of their configuration (i.e. side-by-side, end-to-side, or partial overlap side-by-side that is a multiple of the unit cell dimensions). Since service components will preferably be provided through these apertures, the result is that prefabricated units can be assembled on a construction site in any desired geometric configuration as is. No constructional adaptation is needed.

The building modules, in particular load bearing components of the modules, can preferably be made from steel. The skilled person will however appreciate that other types of material can be used, as is known in the art. Further, beams for use in the building modules can in general be of any suitable structure. Common structure of beams used in construction are I or H-shaped beams, L-shaped beams (also referred to as L angles), or C-shaped beams (also referred to as C channels).

The physical dimensions of the building modules can be standardized to facilitate the modular concept in the building process and to allow transport of the individual modules, such as by trucks, ships or airplanes, observing the height and width limitations of transport routes. The design of the building modules allows for interchangeability and reuse of the building modules. This feature combined with the transportability facilitates an aftermarket in used building modules.

Figure 2:
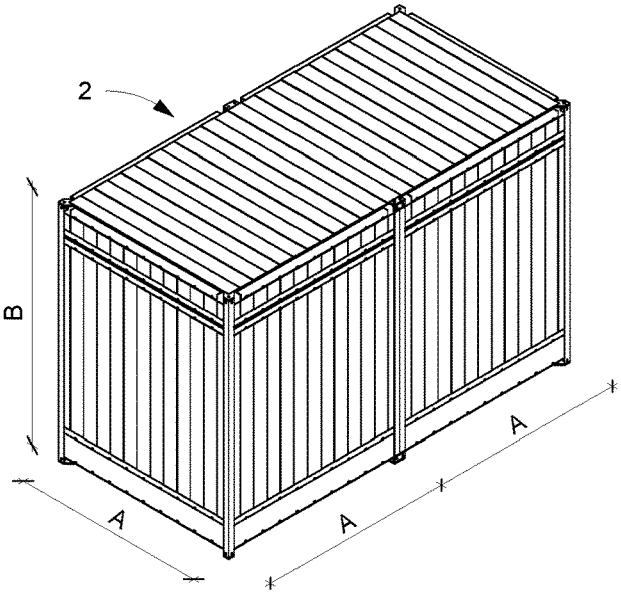
FIG. 2: building module M2—is an isometric view of building module M2 which has the volumetric size of two unit cells.
Figure 3:
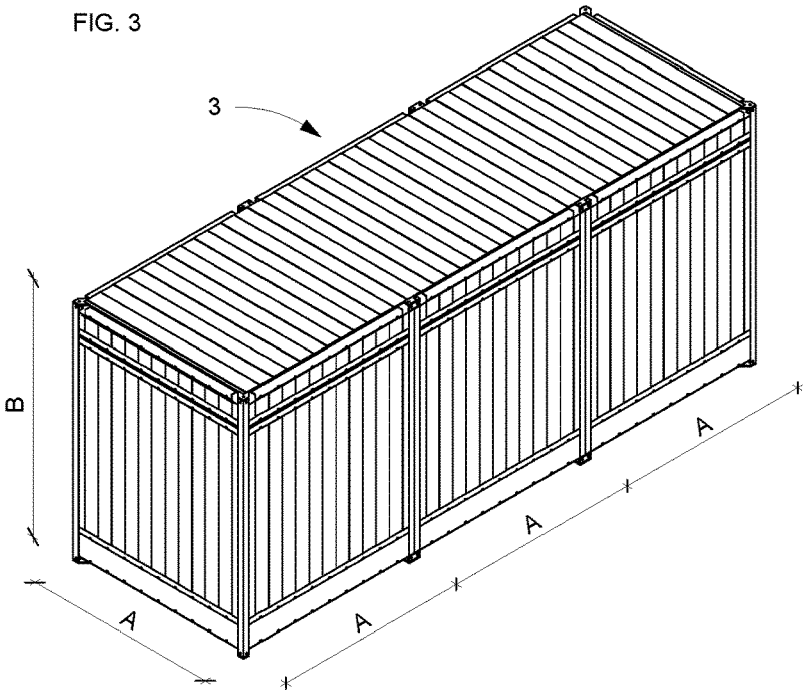
FIG. 3: building module M3—is an isometric view of building module M3 which has the volumetric size of three unit cells.

It can be convenient to standardize the physical dimensions of the building modules to facilitate the modular concept in the building process. For example, there can be a predetermined range of building modules produced for subsequent use in building assembly, in FIGS. 1 to 3 there is illustrated a set of three building modules, comprising one, two and three unit cells each. The building modules are designated M1 (1) (FIG. 1), M2 (2) (FIG. 2) and M3 (3) (FIG. 3). The building modules all have the same width, shown as A in the FIGS. 1-3, but differ in length. The length is an integer multiple of the width, with the multiples being 1×A for module M1, 2×A for module M2 and 3×A for module M3. In general, the length of a building module will be n×A, where A is the width of a unit cell, and n is any (non-zero) integer. The building modules can also have a common fixed height B. Accordingly, each building module can have a volumetric size which is an integer multiple of the basic size unit, hereafter referred to as the unit cell, the multiples for volume being the same as for the lengths. The building system in accordance with the invention will hereafter be referred to as the Integer Modular System.

The modules can be combined in multiple ways to produce different building layouts. The structural system of the modules and their connection capabilities via their connection nodes allow for modules to be placed adjacent to one another, end-to-end, end-to-side or side-to-side, or on top of other modules thus producing multi-story buildings. Modules can be connected via, their connection nodes that are located at regular intervals corresponding to corners of the unit cells. Thereby, complex structurers can be fabricated in a modular fashion using connection means provided at connection nodes.

Figure 4:
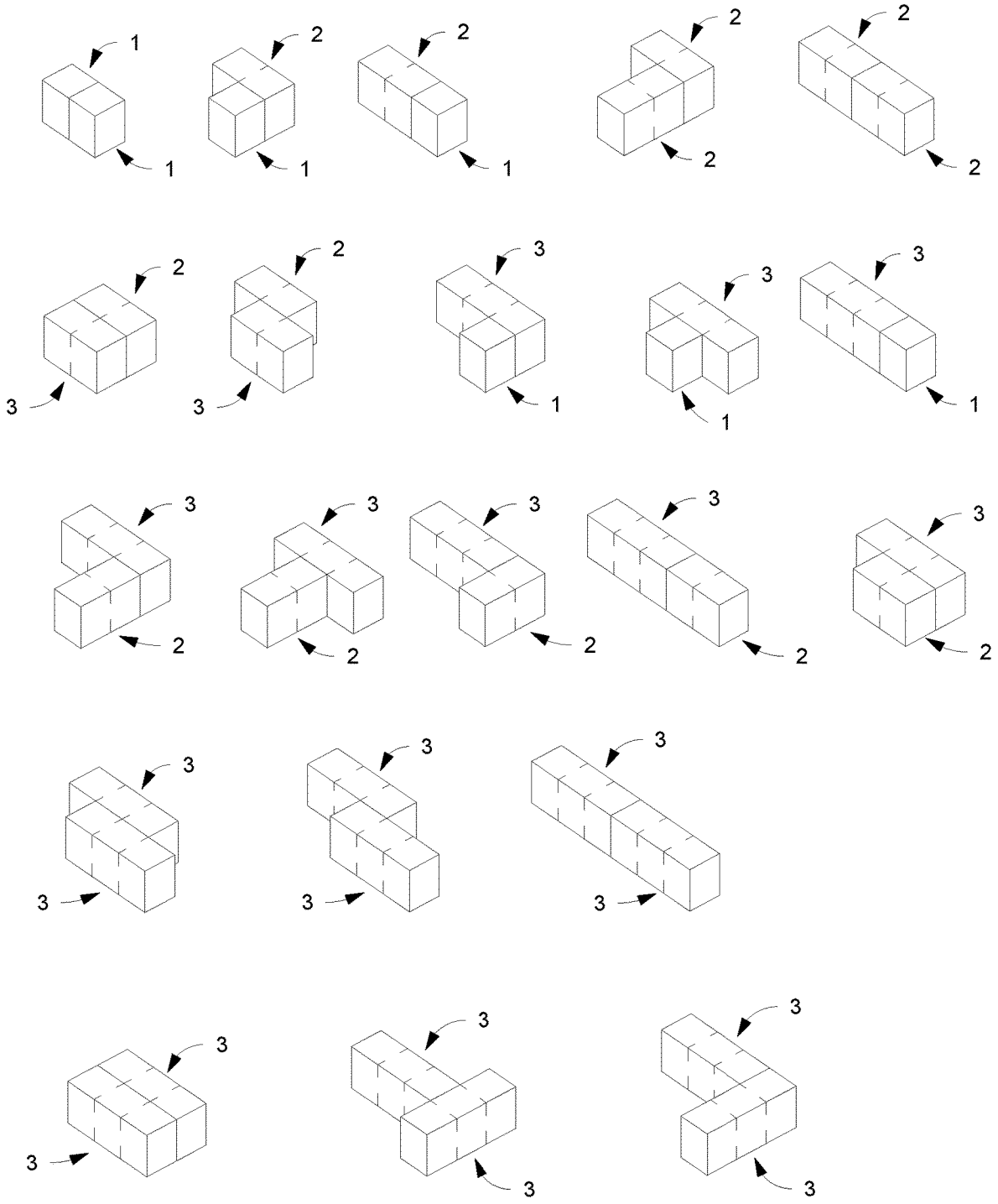
FIG. 4: Combination possibilities of building modules at the same elevation—shows the possible configurations of adjacently placed building modules in isometric view. Additional configurations may be generated by mirror operations on non-symmetric configurations.

The basic combination possibilities for two modules, using the building modules M1, M2 and M3 at the same elevation are illustrated in FIG. 4. In total there are 21 basic ways in which two such modules can be combined at the same elevation. Additional possibilities of combination are generated by a mirror operation on those of the illustrated possibilities that are not symmetrical. When additional or different modules are used (i.e., M4, with four unit cells, M5, with five unit cells, etc), the possibilities of combining the modules increase in number.

In addition to arranging and connecting the building modules in a multiplicity of ways at the same elevation, the building modules can be placed on top of other building modules. The arrangement of the building modules at a second elevation can be such that the building modules lie across the boundaries between modules at the ground level (ground elevation). In general, the placement and rotation of the building modules at the second elevation on top of the first has the same freedom as there is at the first elevation on the condition that support is provided for the second elevation building modules by the first elevation building modules.

Figure 5:
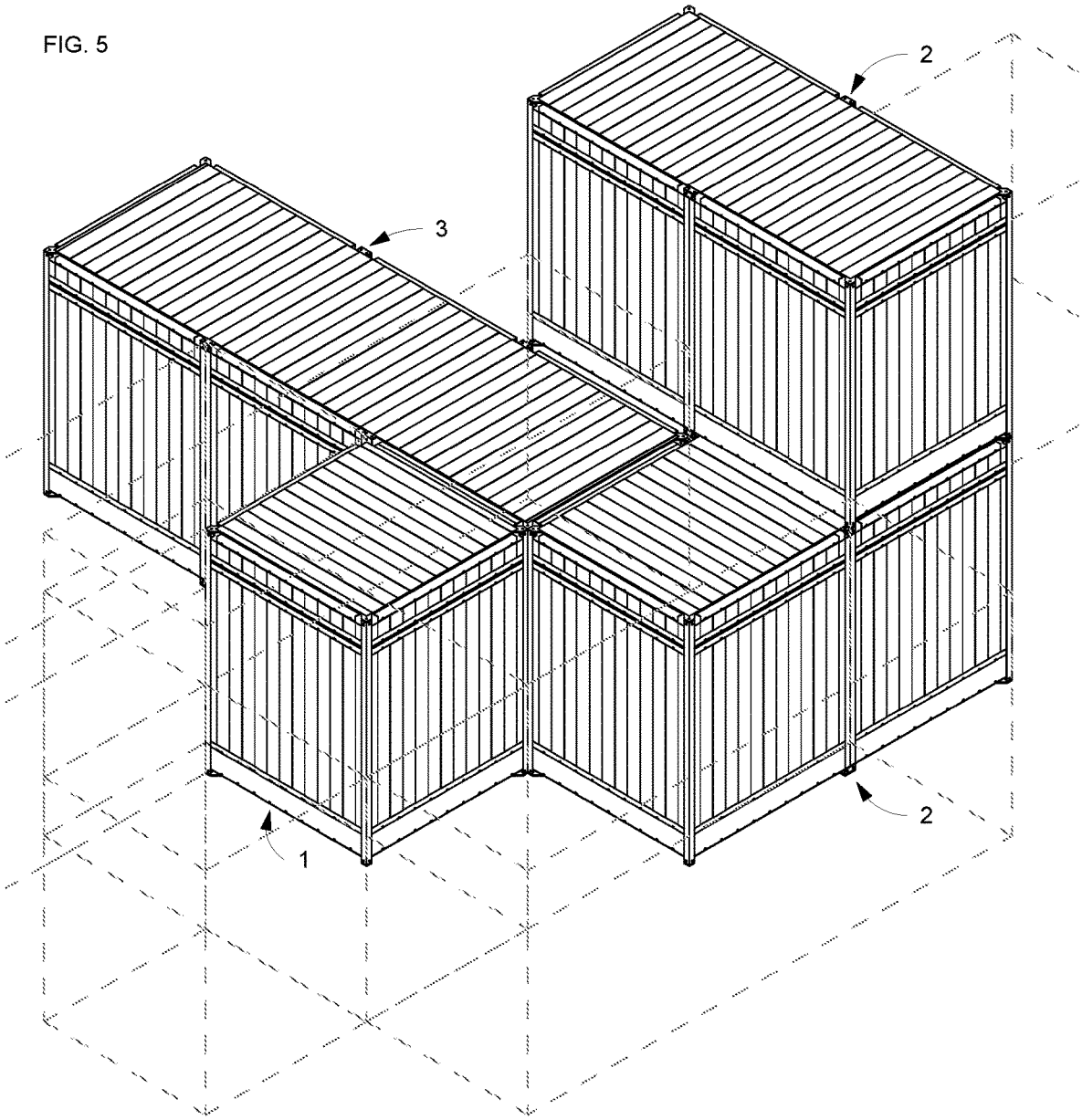
FIG. 5: Combination of modules in three dimensions—illustrates in an isometric view how building modules can be placed both horizontally to and on top of other such modules to construct multi-story buildings.

The modularity of the Integer Modular System both in the horizontal and vertical directions is illustrated by the example shown in FIG. 5. In this example, a building assembly is illustrated, comprising three types of building modules M1, M2 and M3 (1,2,3), that have been assembled in three dimensions. Thus, shown is a building module M3, consisting of three unit cells, that has been connected to a single unit cell building module M1 (1) and to a two-unit cell building module M2 (2). A further building module M2 has been assembled on top of the first story of the resulting building construct, to give a two-story building construct. A fourth building module not visible in the figure is positioned below this further M2 building module. Additional building modules that could represent further additions to a building assembly are illustrated by broken lines in FIG. 5.

It will be apparent to the skilled person that the building modules can be assembled to generate building assemblies containing any desired combination and placement, horizontally and vertically, as long as the structural integrity of the resulting assembly is not compromised. Thus, in general the building assembly can comprise one or more vertical levels (stories), such as one level, two levels, three levels, four levels, and so on. A unique characteristic of the building modules is the capability of combining the modules in any desired fashion, the basic structural unit being represented by the unit cell.

It can be preferable that the unit cell has a width and length (exterior width and exterior length) that is in the range of 2200 mm to 3000 mm, such as 2300 mm to 2800 mm, such as 2400 mm to 2700 mm, such as 2500 mm to 2600 mm, such as about 2550 mm. The height of the unit cell can in general be as appropriate for the functionality that is required of the resulting building modules, taking into account requirements for desired ceiling height, requirements for insulation, electrical wiring, plumbing and the like. For example, the height of the unit cell (exterior height) can be in the range of 2800 mm to 4000 mm, such as 3000 mm to 3800 mm, such as 3200 mm to 3600 mm, such as 3300 mm to 3400 mm, such as about 3350 mm.

An advantage of the building modules of the invention is that the building module exterior heights are not defined or limited by the ISO container exterior dimensions. This allows the building modules to be constructed with a height which allows for a ceiling height from floor to ceiling of at least 2500 mm, as expected in buildings meant for human habitation. Prior art designs have been limited to standard container dimensions which limits the interior heights of the building modules, as the exterior heights of containers are either 2438 mm, 2591 mm or 2896 mm in the case of high cube containers. This complicates the construction of building modules with a height from floor to ceiling of at least 2500 mm allowing for a structurally sound floor construction and a dropped ceiling with space for pipework and ducts. These drawbacks are overcome by the present modular building construct, which is not limited by these height constraints.

In an embodiment, the size of the unit c and the outside dimensions of the different modules M1, M2 and M3 are as listed below:

Unit cell: width=2550 mm, length=2550 mm, height=3350 mm.

Module M1: width=2550 mm, length=2550 mm, height=3350 mm.

Module M2: width=2550 mm, length=5100 mm, height=3350 mm.

Module M3: width=2550 mm, length=7650 mm, height=3350 mm.

The Integer Modular System (building modules and resulting building assembly) is an important distinction of the invention from prior art, as it allows the building modules to be arranged in ways that are not possible with prior art adhering to standard sizes, such as the ISO standard container sizes. When building modules adhering to the ISO size range are arranged contiguously such that one module is rotated by 90° with respect to the other modules, which are arranged side by side lengthwise along the rotated module such that their ends adjoin the rotated module, by necessity there will be a mismatch between the length of the rotated module and the combined length of the other modules. This illustrates the constraints of the adherence of the prior art to the ISO standard sizes.

By contrast, by means of the Integer Modular System, the present invention allows for configurations of building modules of a great variety of designs that is not possible with the adherence to ISO standard sizes. The building modules can be arranged in area plans of many proportions. The individual building modules can have a rotation of 0°, 90°, 180° or 270° with respect to any of the other modules. Modules can be placed on top of other modules in a variety of ways and orientations.

The connections between modules can be made with steel bolts that join the structural members of the modules. Each exterior face of each unit cell of each building module can be endowed with four connection nodes (4-7) that are arranged in a modular system to allow for connections of the building modules in any of the ways demanded by the Architectural Modular Building System. In an embodiment of the invention, the lateral distance between connection nodes along an edge is about 2460 mm and the vertical distance between connection nodes along an edge is about 3248 mm. It will however be appreciated that the unit cells, and thereby the resulting building modules, can be of any other desired dimension, and as a consequence also the lateral and vertical distances between connection points.

Figure 8:
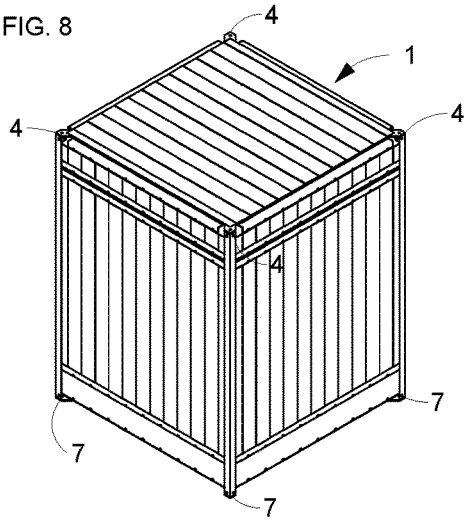
FIG. 8: Connection locations of module M1—illustrates in isometric view the connection nodes on an M1 module.
Figure 9:
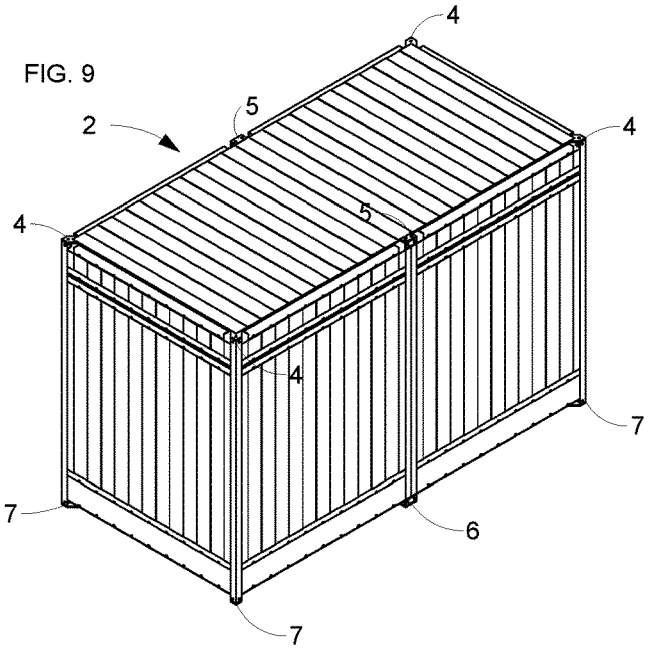
FIG. 9: Connection locations of module M2—illustrates in isometric view the connection nodes on the M2 module.

The module M1 shown in FIG. 8 has eight connection nodes, four at the upper corners (4) and four at the lower corners (7). In each connection node there are three connection points for a total of 24 connection points for the module M1. The module M2 shown in FIG. 9 has twelve connection nodes, four at the upper corners (4), four at the lower corners (7), two at the upper middle edges (5) (i.e. at the upper edge along the longitudinal direction of the module that connects two adjacent upper corners) and two at the lower middle edges (6). The eight corner connection nodes (4) have three connection points each and the four edge connection nodes (5,6) have four connection points each, making a total of 40 connection points for the M2 module.

Figure 10:
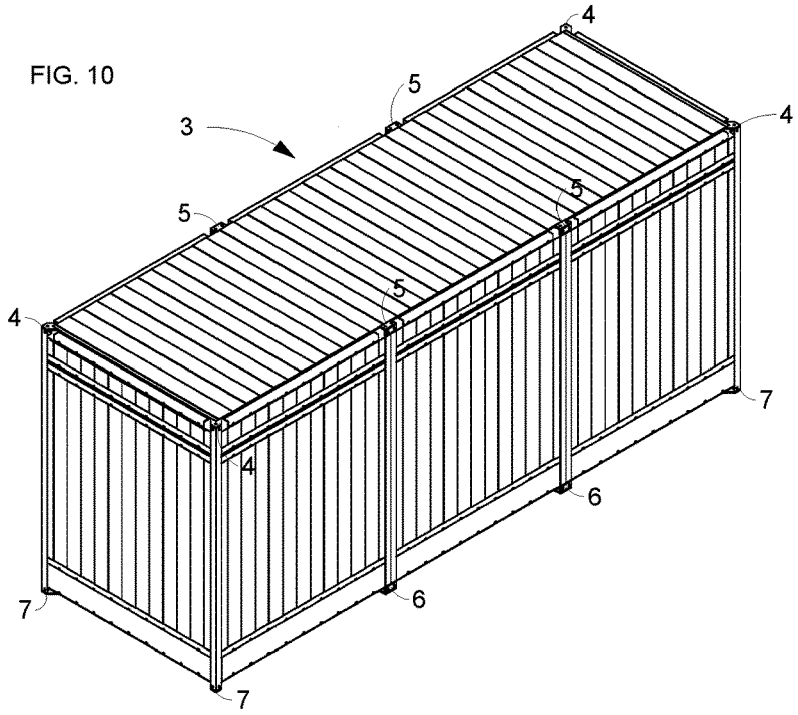
FIG. 10: Connection locations of module M3—illustrates in isometric view the connection nodes on the M3 module.

The module M3 shown in FIG. 10 has sixteen connection nodes, four at the upper corners (4), four at the lower corners (7), four at the upper edges (5) and four at the lower edges (6), along the longitudinal direction of the module. The distance between connection nodes along the upper and lower edges are equal. The eight corner connection nodes (4,7) have three connection points each and the 8 edge connection nodes (5,6) have four connection points each making a total of 56 connection points for the M3 module.

Figure 11:
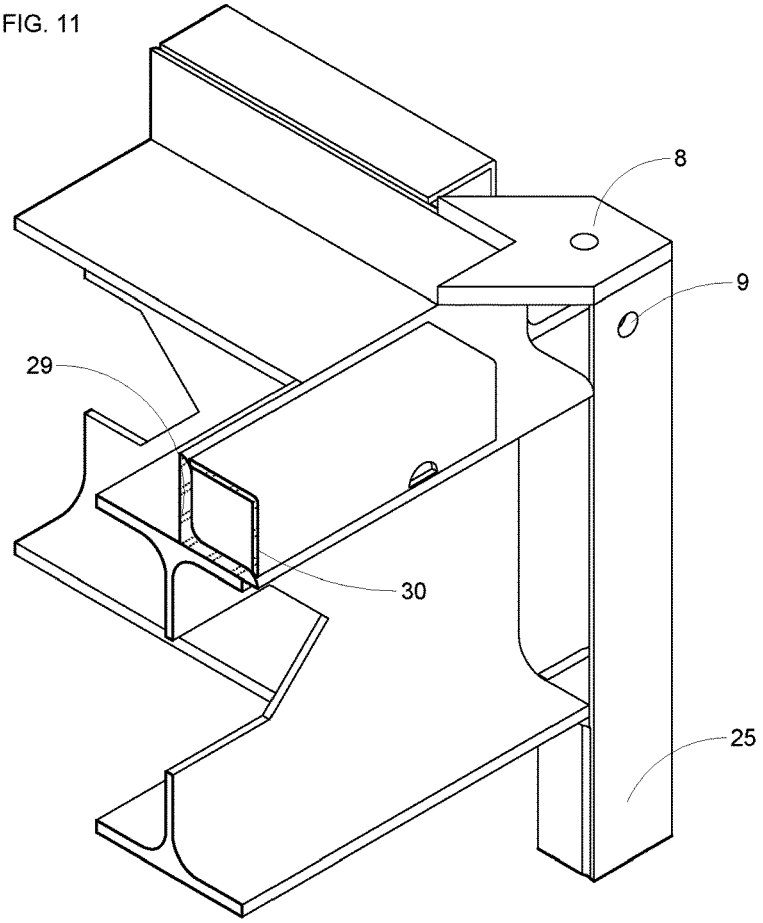
FIG. 11: Upper corner connection location—shows the connection capabilities of an upper corner connection in isometric view.
Figure 12:
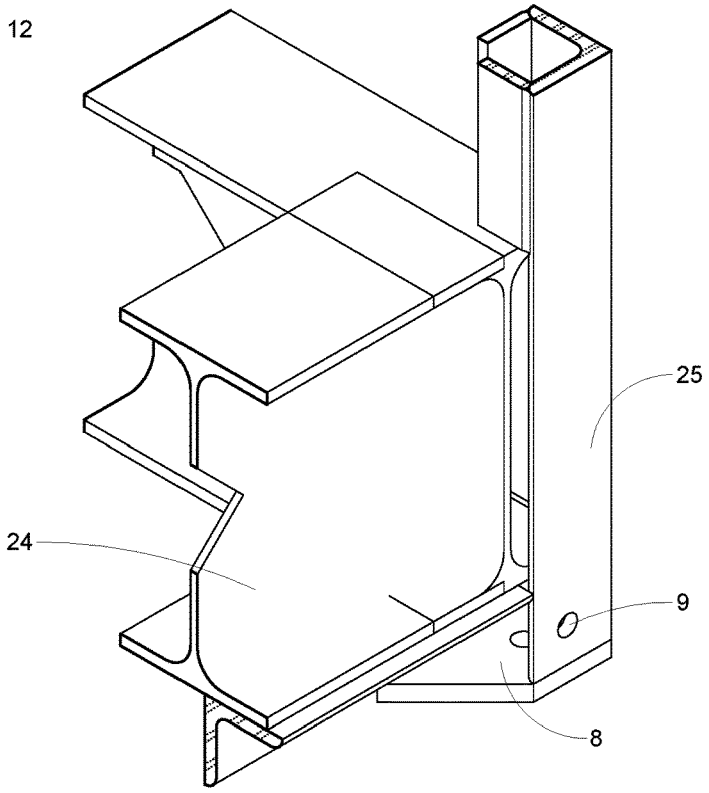
FIG. 12: Lower corner connection location—shows the connection capabilities of a lower corner connection in isometric view.

Bolted connections can in general be provided by any means known in the art. An exemplary embodiment is shown in FIGS. 11 and 12, showing connection nodes at upper and lower ends of corner columns (25), respectively. I-shaped beams (24) are connected to each vertical corner column (25). Such beams can extend between corner columns. Alternatively, the beams can extend between a corner column and a support column on a longitudinal side of a building module. The beams can also extend between adjacent support columns on a longitudinal side of a building module, i.e. a building module having two or more support columns along at least one longitudinal side. Bolt holes (9) are provided in the vertical steel corner columns (25) and by bolt holes in plates (8, 10, 11) that are welded to the frame members (see FIG. 14 and FIG. 15). L shaped angles (29) that can be provided along the edges between corner and/or support columns of the building modules (see e.g. FIG. 11) provide additional load bearing support. The plates and angles can preferably be made from steel.

Also shown in FIG. 11 are steel angles (30) that can extend laterally between corner columns and/or support columns. The steel angles provide additional support and can also be used for attachment of exterior wall units (see also FIG. 30).

Figure 13:
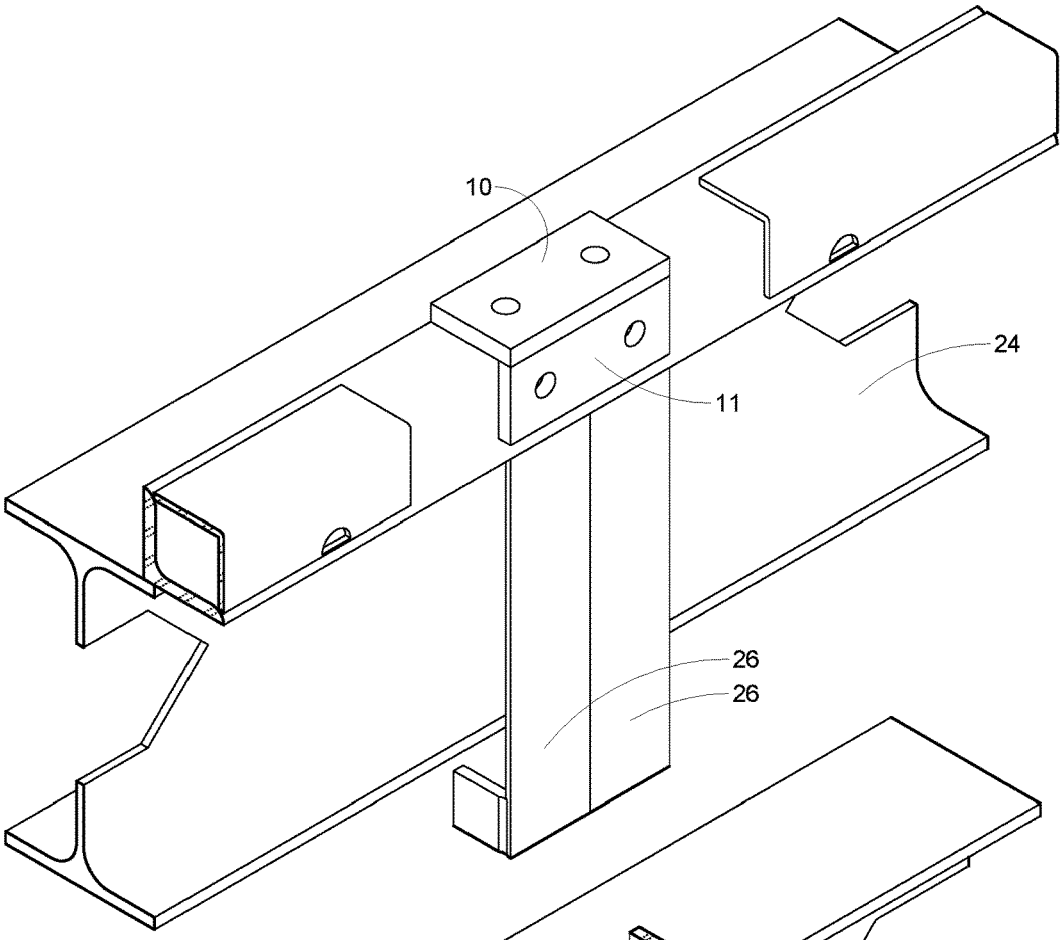
FIG. 13: Upper middle connection—shows the connection capabilities of upper middle connection nodes in isometric view.
Figure 14:
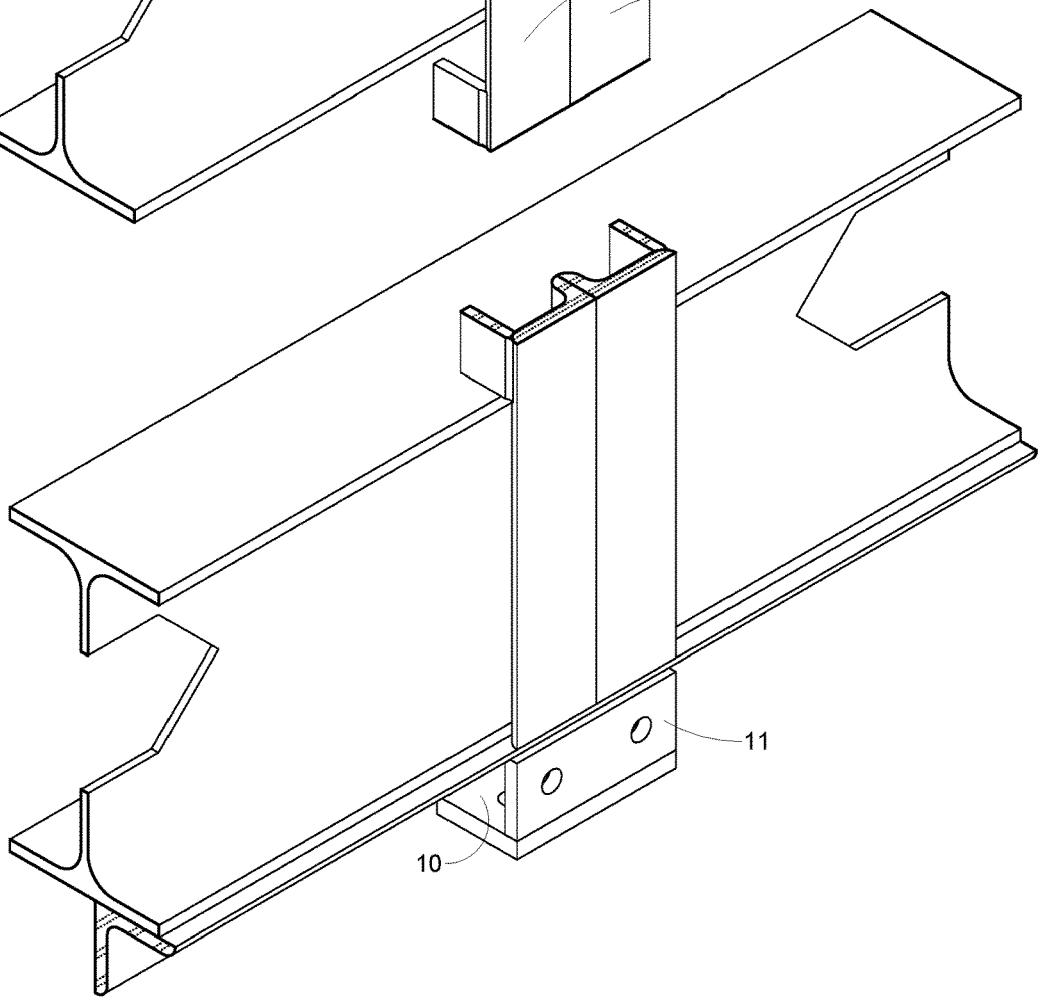
FIG. 14: Lower middle connection—shows the connection capabilities of lower middle connection nodes in isometric view.

In FIGS. 13 and 14 it is shown how the plates (10,11) can be used to connect elements of the building module, through bolt holes provided in the plates. It will be appreciated that alternative geometrical shapes and placement of the plates and/or the number of bolt holes in the plates can be varied as deemed desirable to achieve required and/or desirable connections of the building assembly.

As can be seen front FIGS. 13 and 14, support columns in this embodiment are at their respective upper and lower ends connected to L-shaped plate assembly formed by plates (10,11) that serve as connectors to adjacent building modules. Thereby, the effective vertical support column is represented by vertical corner and support columns (25,26) and vertical plate (11).

Figure 15:
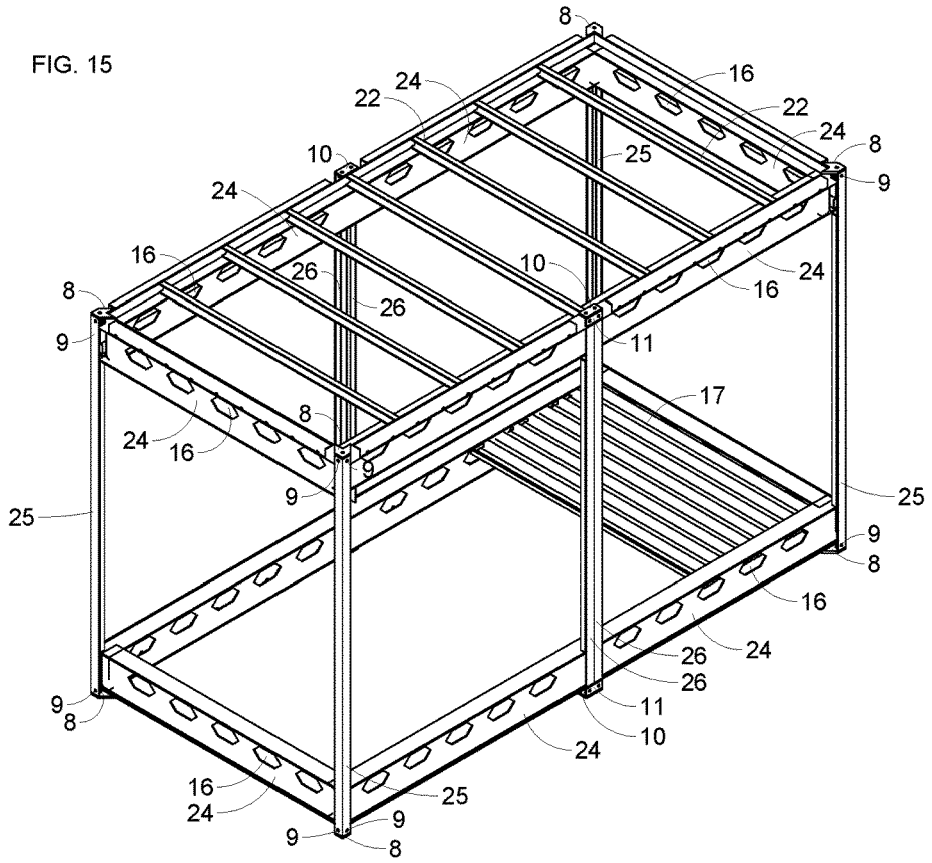
FIG. 15: Shows a structural system of a building module consisting of two unit cells—isometric view.
Figure 16:
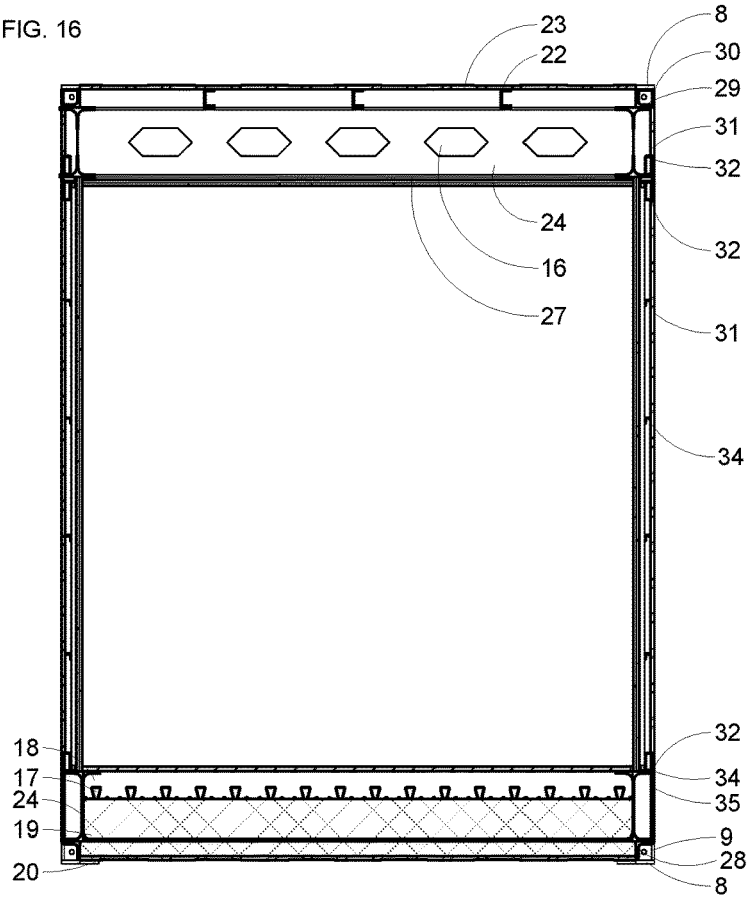
FIG. 16: Shows a sectional view of a building module.

The details of a structural system in accordance with the invention are shown in FIG. 15-FIG. 16. The figures depict a primary load bearing building module M2, which comprises two unit cells and is comprised of a plurality of structural members. The structural members can in general be made from any suitable material, for example steel, Columns of vertical L shaped angles (25) are provided in the corners of the building modules (corner columns). Additional support columns (26) along the longitudinal faces of the building modules are also provided. These support columns are provided at an equal distance from opposite corner columns (25) at either end of the longitudinal side of the resulting building module. The system also contains horizontal I shaped beams (24) along the horizontal edges of the building module. The beams are connected to respective corner columns (25) and support columns (26). Exemplary connections are provided by steel plates (8,10,11) that are welded to the construct (e.g., corner and/or support columns). Also shown in the sectional view of FIG. 16 are steel plate panels (31), which correctly placed in the building can provide lateral load restraint and stability to the building assembly. Where not needed for structural purposes the steel plate panels can contain window or door openings. Such steel plate panels can for example be provided with a shallow trapezoidal form, although other suitable forms are also contemplated.

Vertical floor, ceiling and roof loads are transferred to the load-bearing I shaped beams (24) in the longitudinal edges of the modules. The steel beams (24) span the entire length of the modules and transfer the loads to the columns (25,26), which transfer the loads either to the foundation or the module below in multi-story buildings.

Also shown are holes (16) at regular intervals in the beam (24) to provide a passage between building modules for service systems, e.g. piping, electrical cables, etc.

A means for resisting lateral loads such as wind and earthquake loads can also be provided. The steel plate panels (31) present in some of the building frames of the building modules act as shear panels and serve to stiffen the building against lateral movement and loads in the plane of the wall by acting as steel plate shear walls. Because of the interconnections of the modules into a single structure, the steel plate panels (31) in some building modules can provide lateral restraint and stability to the whole building. The location and necessary number of shear walls depends on the particular building configuration. The provision of a sufficient strength of the shear walls is dependent upon the building design and location and will be determined in each case from structural engineering principles. The joining of elements of the structural frame and the joining of the steel plate panels (31) to the structural frame is done by welding, ensuring the stiffness and load bearing capacity required.

There can also be provided a secondary load bearing structural system in the top faces of the building modules. Such a load bearing system can comprise structural steel members such as U shaped channels (22), as shown in FIG. 16, that support a top face steel cladding (23). The building module shown in FIG. 16 furthermore supports a dropped ceiling (27), plumbing systems, electrical and data cabling systems and air handling systems.

Also shown in FIG. 16 are upper lateral attachment steel angles (30), lateral attachment steel tubes (32); and lower lateral attachment steel plate (35). These can be used for attaching wall panels to the building modules, including insulation panels (see also FIG. 31).

Figure 17:
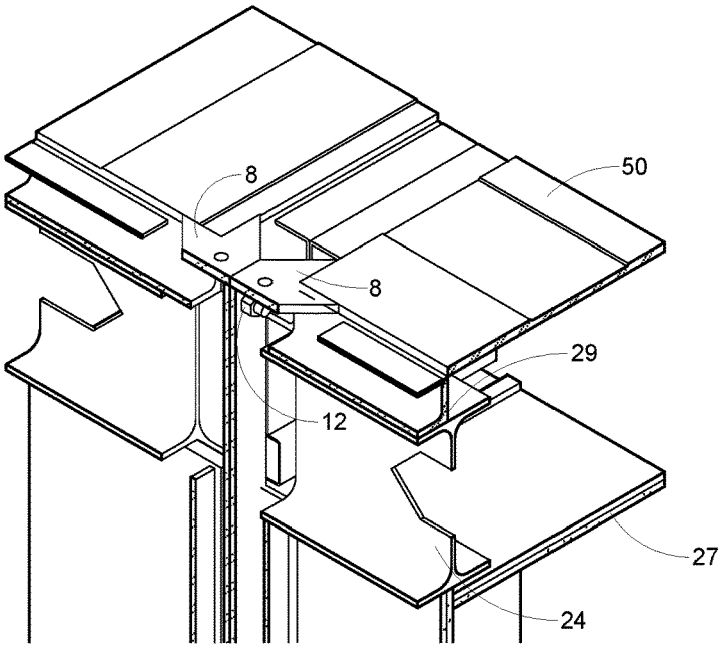
FIG. 17: Shows a lateral corner connection of building modules isometric view.
Figure 17:
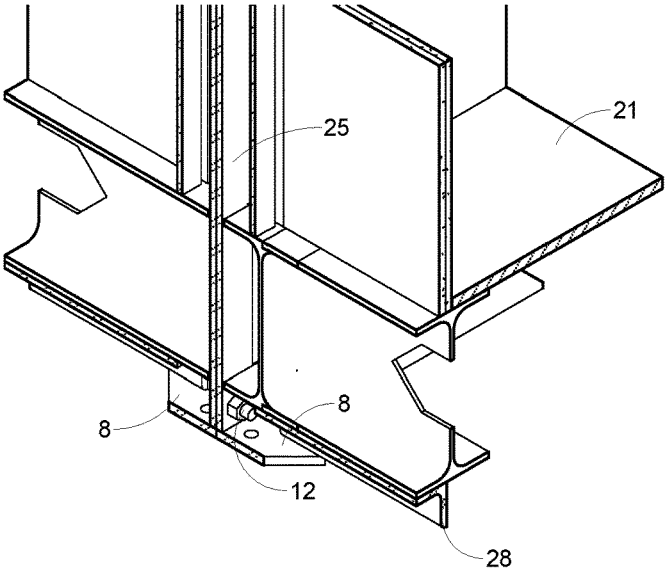

Secondary load bearing and attachment structural members can be provided along the edges of the building modules. These can for example be provided as L shaped steel angles (29), as shown in FIG. 17. In this figure, there is shown a section of the corner of two adjacent building modules, with bolts (12) being provided near the top and bottom of the corner columns, to connect the two modules. Additional connections can be provided via holes on plates (8) at the top and bottom of the corner columns.

Also shown in FIG. 17 are support members in the form of lower lateral edge steel angles (28) and upper lateral edge steel angles (29). These steel angles connected to (e.g., by welding) steel I-shaped beams (24), providing support to the thermal insulation panel units (43).

Figure 20:
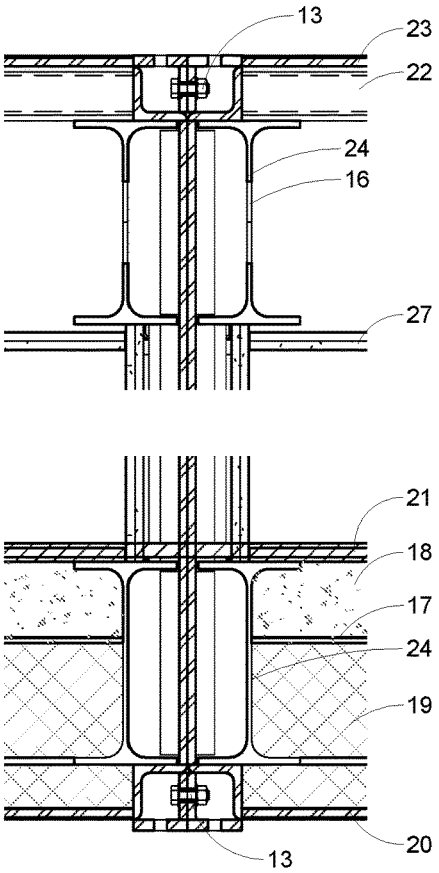
FIG. 20: Shows a lateral side connection of building modules—sectional view.

The building construct can be provided with a composite floor system comprising a corrugated steel deck (17) and concrete deck (18), providing load carrying capacity, sound insulation and fire resistance to the floor construction, as shown in FIG. 20 (lower panel). The concrete deck (18) may be covered with an optional floor finish material (21) if desired. The structural loads from the composite floor system are transferred to the primary load bearing beams in the bottom face of the building modules. The floor system incorporates thermal insulation (19) beneath the corrugated steel deck and a bottom face steel cladding (20) to seal the underside of the building modules.

Connections can be either lateral for connecting building modules at the same elevation (FIG. 17-FIG. 20); or vertical for connections between building modules at different elevations (FIG. 21-FIG. 24); and/or there can be connections of building modules to foundation elements (FIG. 25) and/or connections of roof elements to the uppermost building modules. Connections use connection points arranged at connection nodes in the frame structure. A steel bolt (12, 13,14,15) is passed through the aligned holes at respective connection points of adjacent building modules and a nut is tightened to a prescribed torque. When present, the bolts (12,13,14,15) go through holes on plates provided at such connection points. Preferably, the structural frame is manufactured to strict tolerances to provide the necessary compatibility between the building modules.

In FIG. 17 it is also shown how floor finishing material (21), ceiling panels (27) and roof panels (50) can be accommodated in the building modules.

Figure 18:
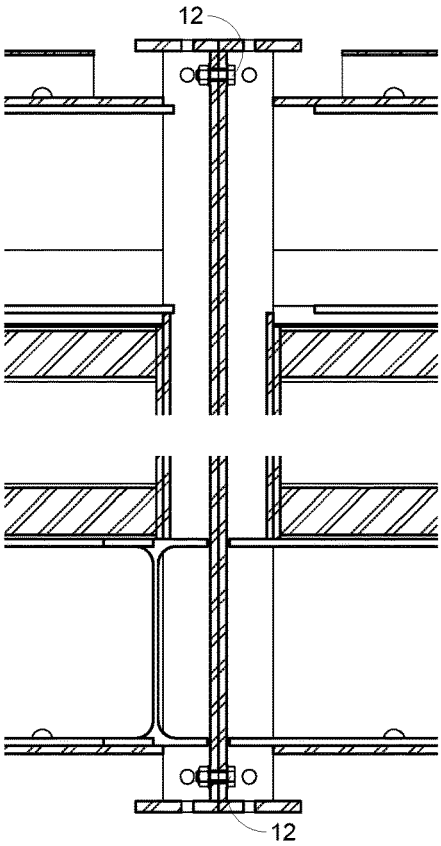
FIG. 18: Shows a lateral corner connection of building modules sectional view.

S A sectional view of the connections of adjacent building modules via bolts (12) that pass through columns (25) of two adjacent building modules is shown in FIG. 18. The placement of bolts, and corresponding holes in the corner columns, can be varied as desired, as can the number of bolts—there can thus be additional holes provided in the corner columns for connections via additional bolts.

Figure 19:
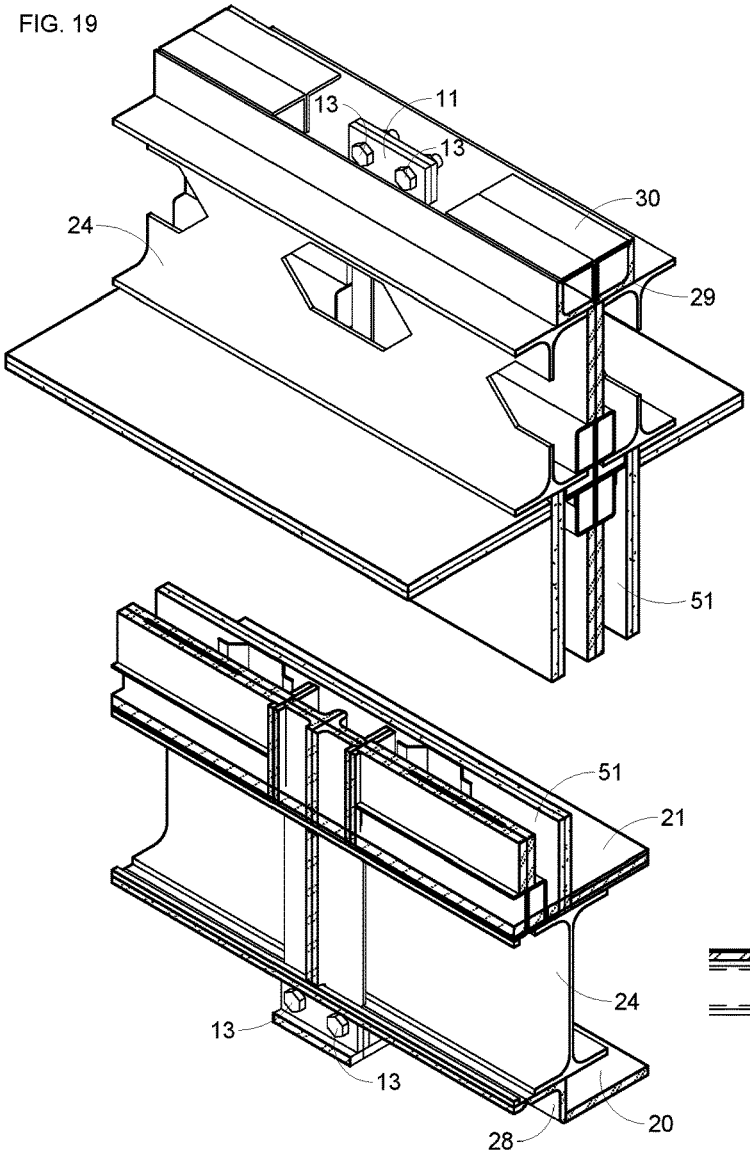
FIG. 19: Shows a lateral side connection of building modules isometric view.

In FIG. 19, it is shown how adjacent building modules can be connected along their sides. The figure shows the uppermost section (upper figure) and the lowermost section (lower figure) of a section of two adjacent building modules. Bolts (13) extend through steel plates (11) to secure and fasten two adjacent building modules together. The two lower bolts and the two upper bolts are positioned at respective connecting nodes on unit cells within each module. The steel plates are positioned directly above and below support columns (26). Additional structural support is provided by lower lateral edge steel angle (28) that is positioned directly below and connected to lateral I-beam (24). The figure also shows upper lateral edge attachment steel angles (30) that can be used for attaching external wall panels (see also FIG. 31).

A sectional view of two adjacent building modules is shown in FIG. 20, where for the sake of clarity only the uppermost and lowermost sections of the two modules are shown. Bolts (13) can be seen to be connect the two adjacent building modules. If needed, additional bolts can be provided, or the bolts can be provided with different placement than what is shown in this example.

Figure 21:
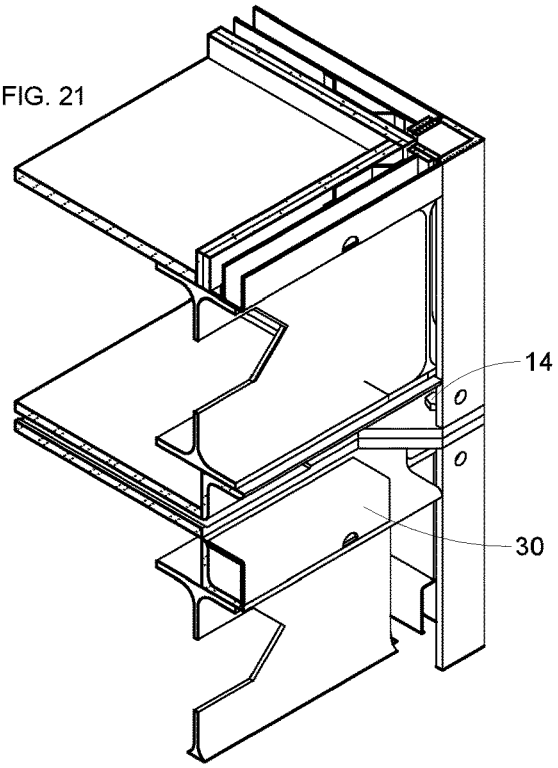
FIG. 21: Shows a vertical corner connection of building modules—isometric view.

FIG. 21 shows a vertical connection of adjacent building modules at corner connection nodes. Bolts (14) are used to secure vertically stacked building modules at their respective corners via plates (8), thereby aligning corner columns of a building module to the corner column of an adjacent vertically stacked building module. Also shown are steel angles (30) that can be used for attaching wall panels to the building modules.

Figure 22:
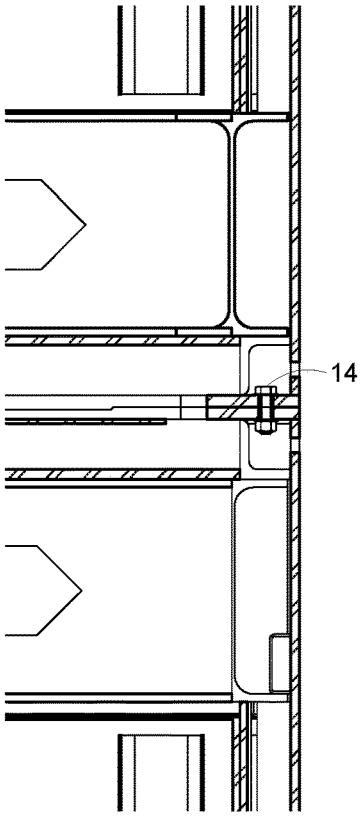
FIG. 22: Shows a vertical corner connection of building modules—sectional view.

In FIG. 22 there is shown a sectional view of the connection, showing how bolt (14) extends through plates (8) to connect stacked building modules.

Figure 23:
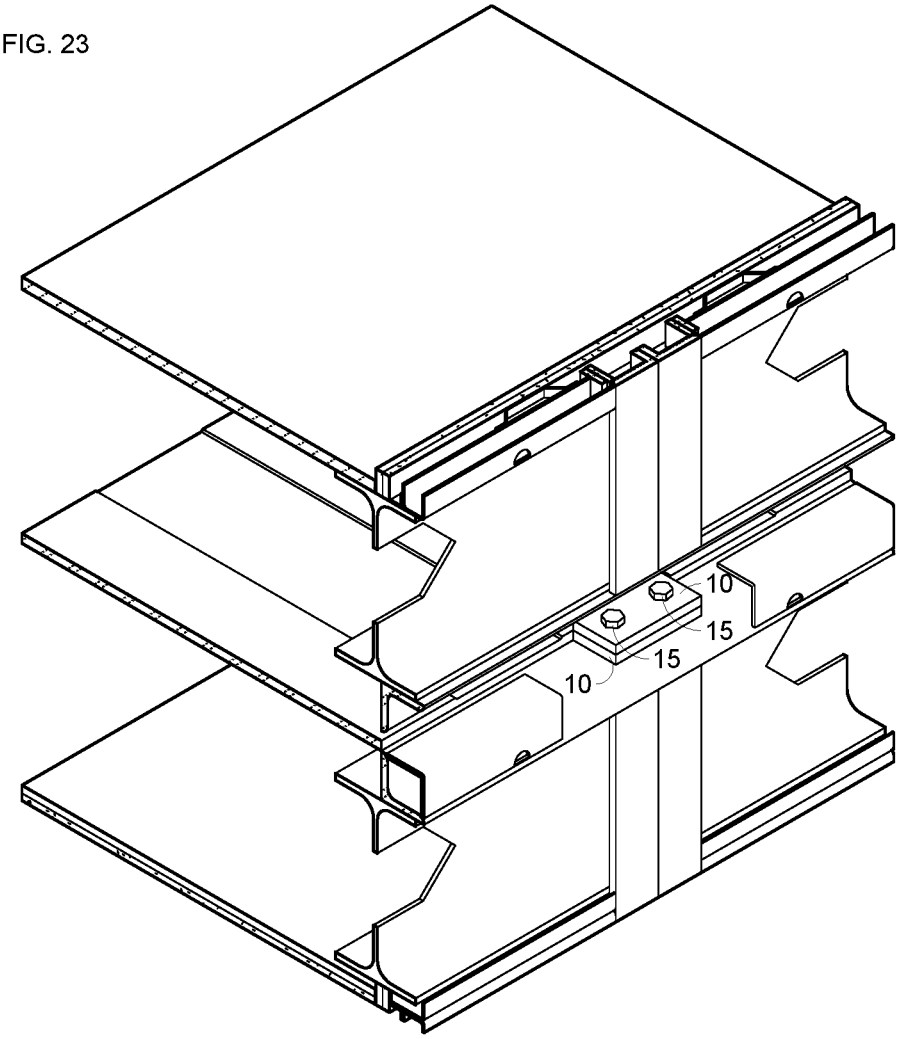
FIG. 23: Shows a vertical side connection of building modules—isometric view.
Figure 24:
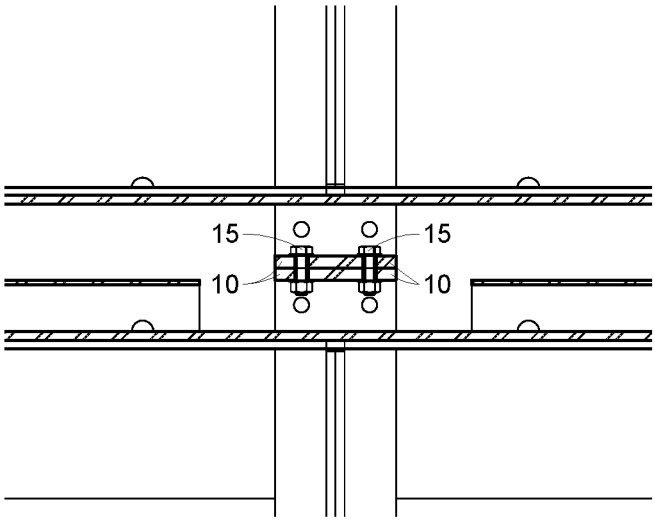
FIG. 24: Shows a vertical side connection of building modules—sectional view.

Yet another connection modality, at side connection nodes of a building module is shown in FIG. 23. Here, vertically stacked building modules are connected along their sides, via bolts (15) that extend through plates (10) on adjacent building modules (see also FIG. 15). A sectional view of such a connection is shown in FIG. 24.

It will be appreciated that additional and/or alternative means can be used to connect adjacent building modules in a building assembly in accordance with the invention. Thus, generally any means for connecting the building modules that are known in the art can be used, as long as adjacent building modules are connected by spatial alignment of their connection nodes, such that adjacent building modules are geometrically lined up at their respective connection nodes. Connection means are preferably provided at the connection nodes. However it is contemplated that additional or supplementary connections can be provided as deemed suitable for each particular building construction.

The Architectural Modular Building System can be implemented by means of foundation elements that are designed to engage with the building system. For example, there can be prefabricated concrete foundation elements (36) designed for the building system. Provided the necessary foundation engineering investigation and design has been performed, such foundation elements may be used as foundations for buildings constructed with the building modules. The selection of the appropriate foundation element for each case will be based upon considerations of the allowable bearing pressure of the underlying soil, the configuration of the particular building, the particular building part resting on the foundation and induced loads due to snow, wind and building usage. The foundation elements are fully interchangeable.

Figure 25:
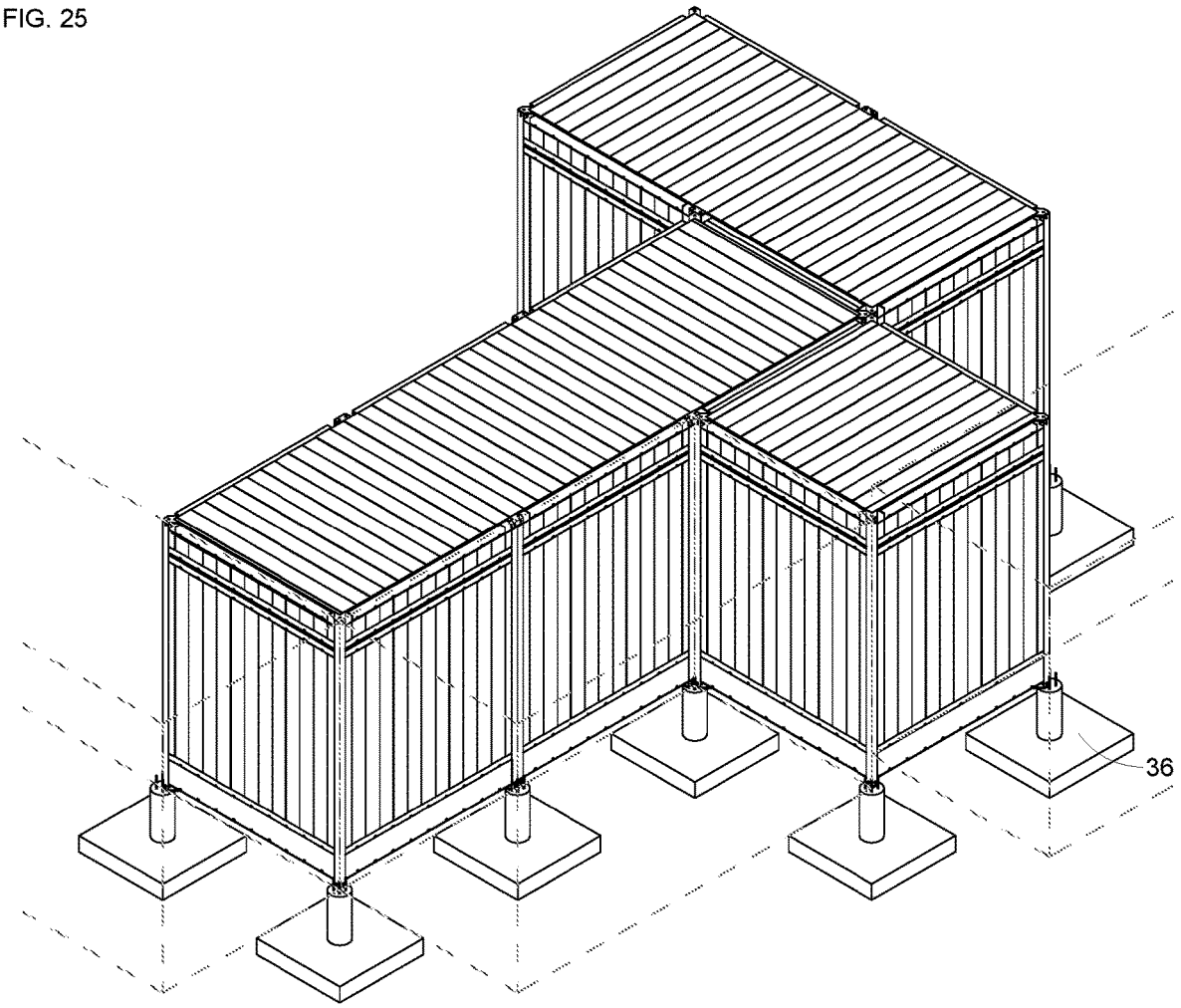
FIG. 25: Shows vertical connection of building modules to foundation elements.

An example of a building on prefabricated concrete foundation elements is shown in FIG. 25. Here, foundation elements (36) are designed to engage with the building modules via anchor bolts extending upwardly from the foundation elements. The anchor bolts are designed to engage with corner and/or support columns of the building modules, and thereby extend the modular functionality of the system to include means to secure the building modules to ground.

Figure 26:
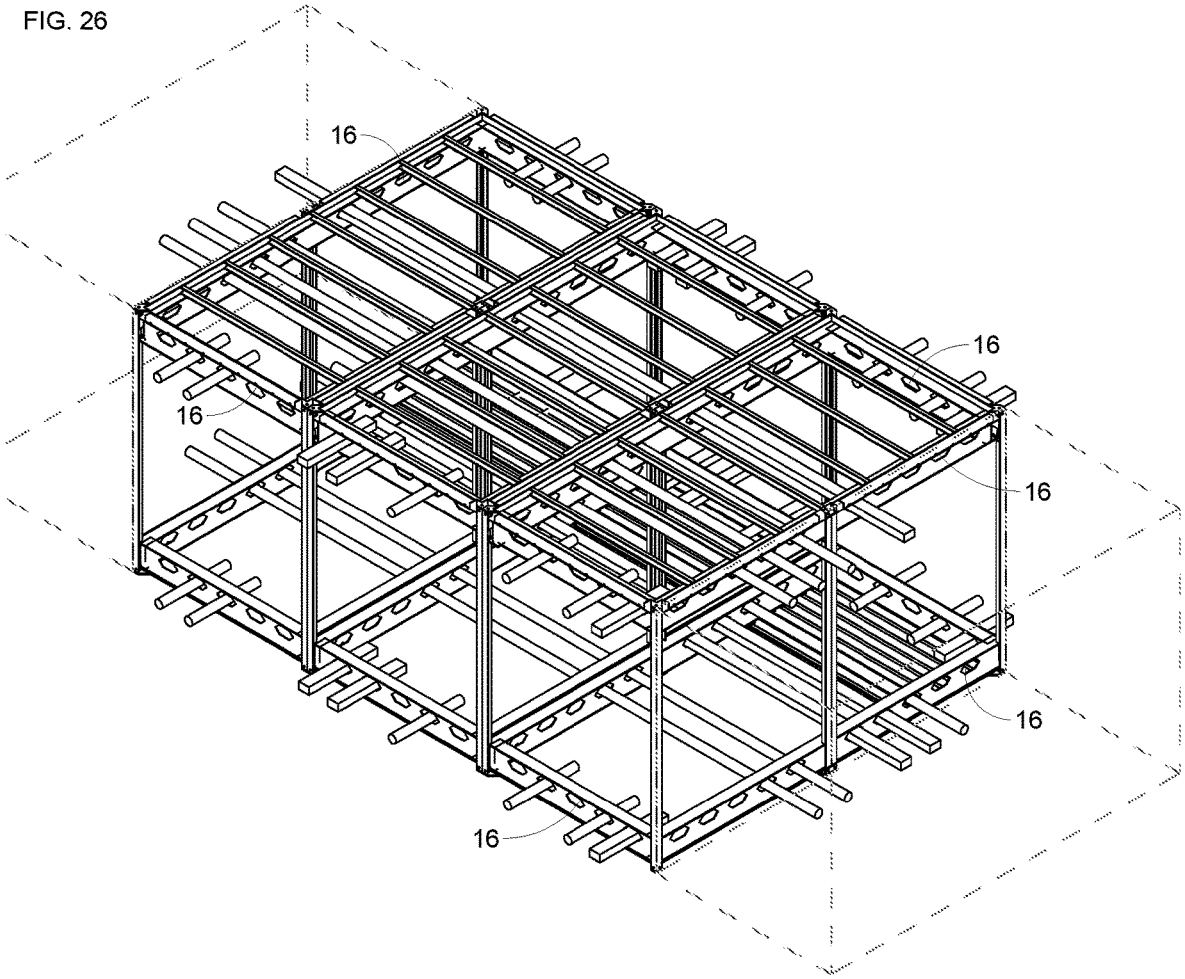
FIG. 26: Shows service installation pathways between building modules.

The building modules can be provided with means to allow for service systems such as sanitary and plumbing systems, electrical and data cabling systems and air handling systems. This can be conveniently done by means of the holes or apertures (16) that are provided in the load beams (24) as illustrated in FIG. 26 (see also FIG. 15). The primary load bearing I shaped beams (24) that are situated at the upper and lower edges of the building modules have large holes (16) at regular intervals in the beam webs located such as to provide a passage between building modules for the service systems, both in the spaces under the floors and above the dropped ceiling. The spacing and location of the holes in the beam webs and the Integer Modular System of arranging the building modules ensure that unobstructed pathways lie between each adjacent and connected building modules. FIG. 26 illustrates the alignment of the holes in structural I-shaped beams of the building modules and the resulting service system pathways. Obviously, the shape, dimensions and interval of the holes can be modified as deemed appropriate to accommodate desired service systems. The modular design of the building system however ensures that the holes on adjacent building modules line up. When two or more building modules are assembled, independent of whether the building modules are aligned end-on (i.e. ends of two building modules meet), side-by-side (i.e., two building modules are assembled side-by-side), or end-to-side (i.e. one building module is perpendicular to an adjacent building module).

A consequence of the modular design of the building modules is that some or all the vertical faces of some of the building modules that meet other modules in a resulting building and are thus interior to the building, can be without steel plate panels or middle steel columns (support columns), thereby making the formation of larger unobstructed spaces possible within the structure that are not confined to a single module. In other words, multiple building modules can be combined to produce an extended open space that corresponds to the combined volume of the individual building modules.

Thus, the lateral ceiling beams along the longitudinal faces of the modules (including M2 and M3 modules), do not require intermediate columns for structural purposes, thereby increasing the size of spaces with unobstructed floor space. The creation of inter-modular unobstructed spaces larger than a single building module is illustrated in FIG. 6 and FIG. 7.

Figure 6:
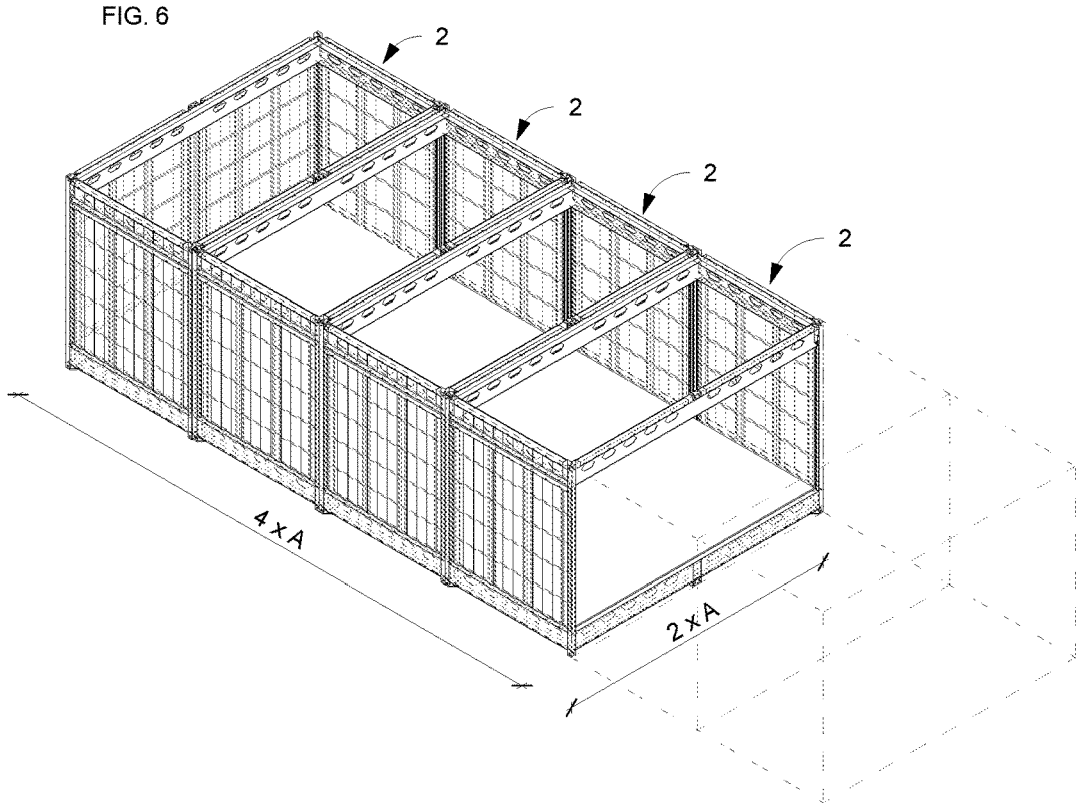
FIG. 6: Unobstructed space creation, example 1—shows in isometric view how an unobstructed space of considerable size can be constructed using many M2 modules, without middle support columns placed side by side within the space.

In FIG. 6, four two-cell building modules (2) have been connected in a parallel fashion via connecting nodes at their top and bottom corners (i.e. at the upper and lower end of vertical supporting columns on each corner of each building module). The building modules do not contain additional vertical columns, and the assembled construct therefore provides a large uninterrupted space corresponding to the four building modules combined. Additional building modules could be added to such a building construct to generate and even larger unobstructed space, as indicated by the dashed lines.

Figure 7:
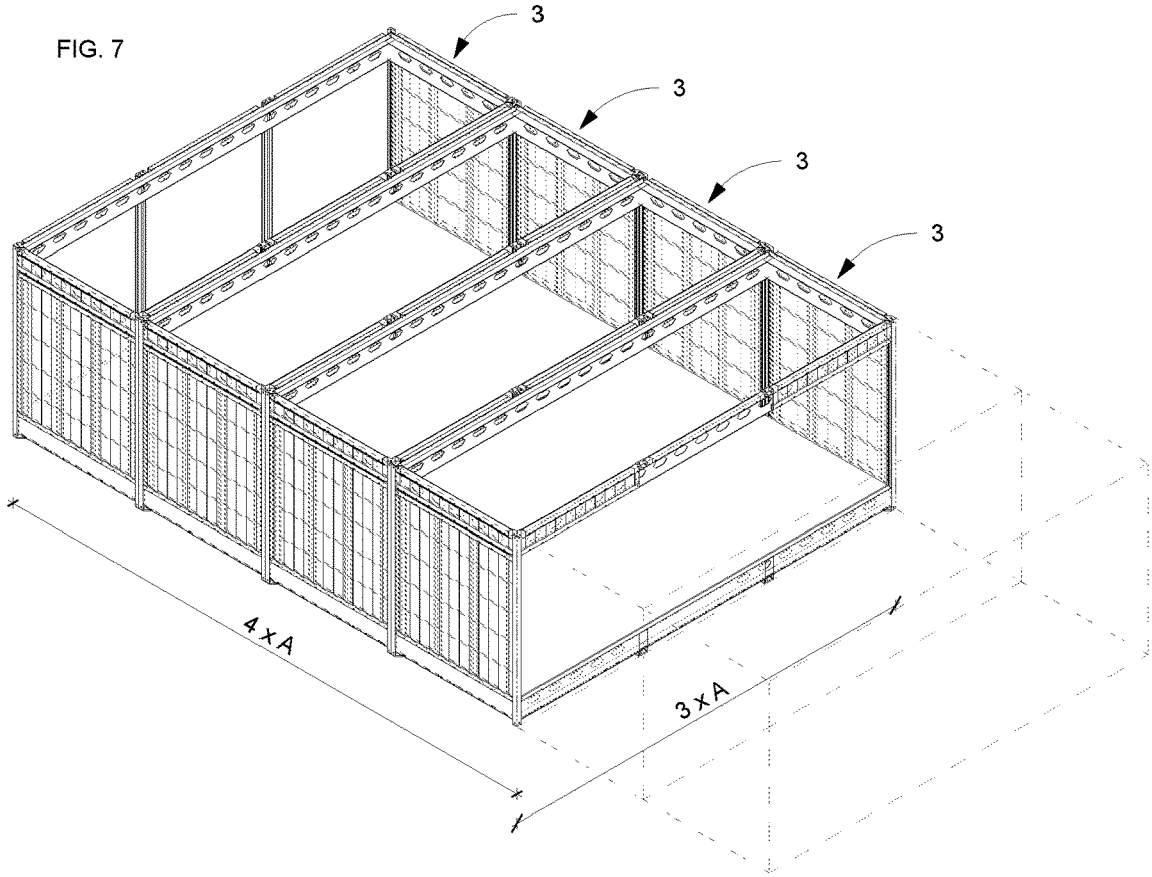
FIG. 7: Unobstructed space creation, example 2—shows in isometric view how an even larger unobstructed space can be constructed with many M3 modules, without middle support columns placed side by side.

A comparable construct is shown in FIG. 7, where four building modules (3), each consisting of three unit cells, have been connected in a parallel fashion via connecting nodes at their top and bottom corners. The resulting parallel assembly of building module has an internal volume corresponding to the sum of the internal volume of four M3 building units, with no additional vertical columns being provided, i.e. there are no vertical columns between respective corner columns of each building module. Additional building modules can be provided to extend the assembly, as shown by the dashed lines.

An advantage of the modular design of the building modules is that the modules can be functionally specialized to provide particular specialized building modules that are designed for a particular purpose. These include, but are not limited to: Toilet building modules, bathroom building modules, kitchen building modules and stairway building modules. The factory production of specialized building modules allows for the efficient installation of the relevant technical installations and equipment required in each type of building module. The Integer Modular System allows for flexibility in placement of the specialized modules according to the requirements of each building. Stairway modules with interior wall units with a fire rating required by fire regulations, allow for the creation of protected escape routes from the upper parts of multi-story buildings.

Figure 27:
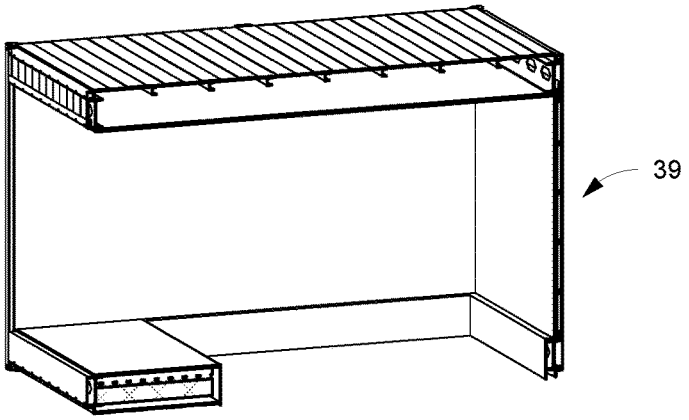
FIG. 27: Top stairway module—shows a specialized stairway building module intended to be placed at the top elevation of a stairway.
Figure 28:
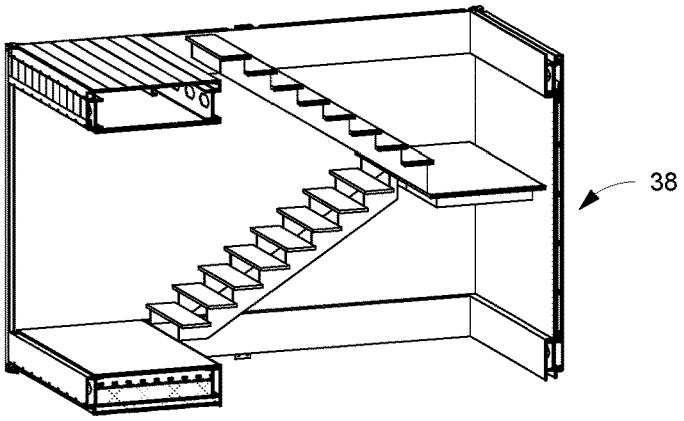
FIG. 28: Intermediate stairway module—shows a specialized stairway building module intended to be placed in intermediate elevations where a stairway is more than two stories high.
Figure 29:
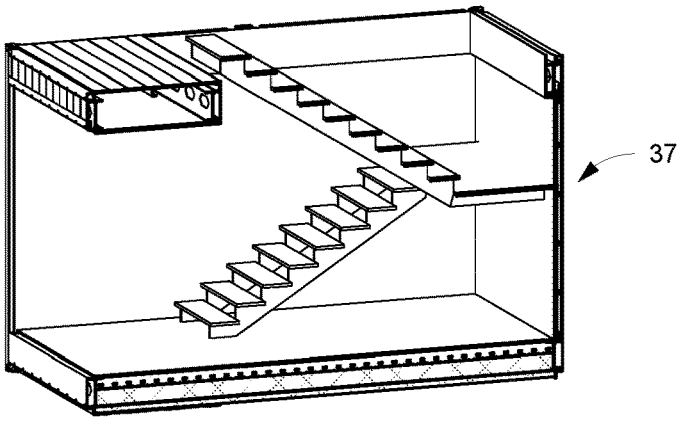
FIG. 29: Bottom stairway module—shows a specialized stairway building module intended to be placed at the lowest elevation of a stairway.

Three types of stairway modules are depicted in FIG. 27-FIG. 29. Shown are ground floor module (37), intermediate floor module (38) and top floor module (39). The ground floor module (37) of FIG. 29 has a regular floor panel, in addition to a stairway functionality that leads up to a vertically aligned stairway module. Such a module (38) can be as shown in FIG. 28, which shows a stairway module that can receive a stairway from a lower level, and also contains a stairway that leads up to a vertically aligned building module. An exemplary top stairway module (39) is illustrated in FIG. 27. This building module has an opening to receive a stairway, but does not contain a further stairway.

The stairway embodiments shown in FIG. 27-29 can obviously be modified as desired, the illustrations merely showing one way in which the modular concept can be extended to include stairways.

Individual building modules can be configured to serve any particular need. Thus, building modules can be adapted for particular functional use. Specialized building modules such as toilet modules or stairway modules can be placed in suitable locations according to the desired building layout.

Figure 30:
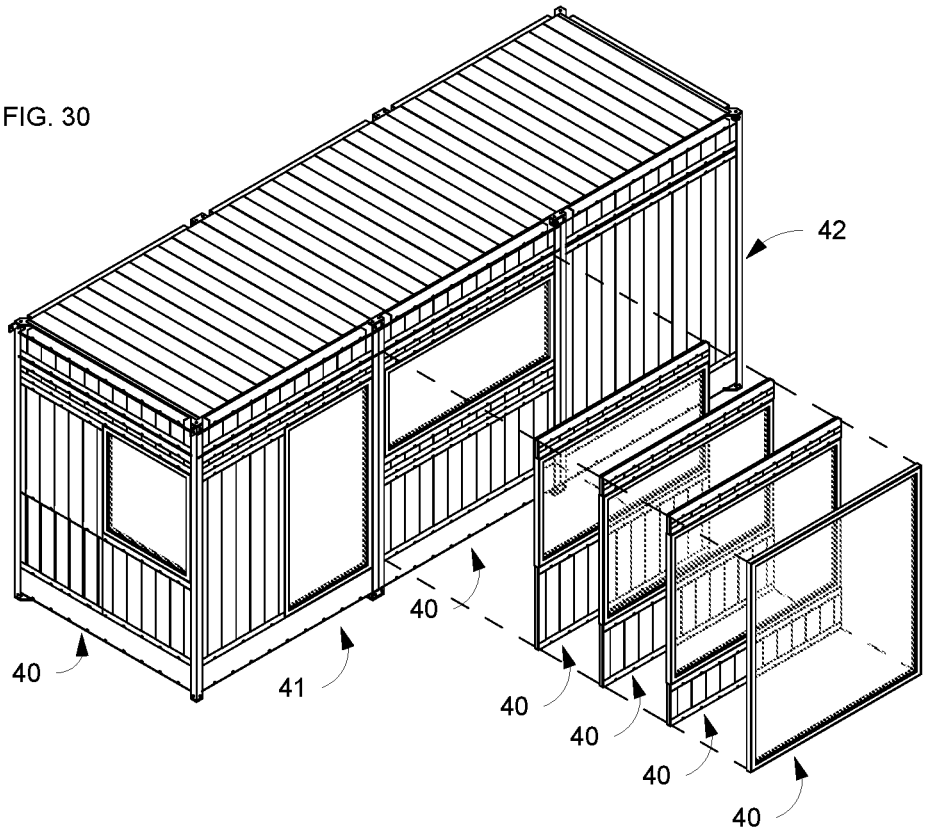
FIG. 30: Exterior wall units—shows a selection of exterior wall units which are attached to the building modules to provide the desired configuration of walls, doors and windows.

In various embodiments of the invention, different exterior wall units can be provided, thereby allowing for different exterior wall configurations to be installed on those vertical faces of the building modules which will lie on the outer perimeter of the building. Exemplary exterior wall units are illustrated in FIG. 30. Shown are whole panel wall units (42) of different sizes, i.e. wall units that close the internal space in the absence of doors or windows. Also shown are various door and window units (40,41), also of different sizes. Exterior wall units with car doors can also be provided. The window units can comprise a set differently sized windows, as well as wall panel units to install above and under the chosen windows. The door units similarly comprise a set of differently sized doors as well as wall panel units to install above the chosen doors. The wall panels are preferably equipped with stiffening angles (34), as shown in FIG. 16. The whole panel wall units also serve the purpose of shear panels as described before. The exterior wall units can be attached to the structural building frame by welding.

Figure 31:
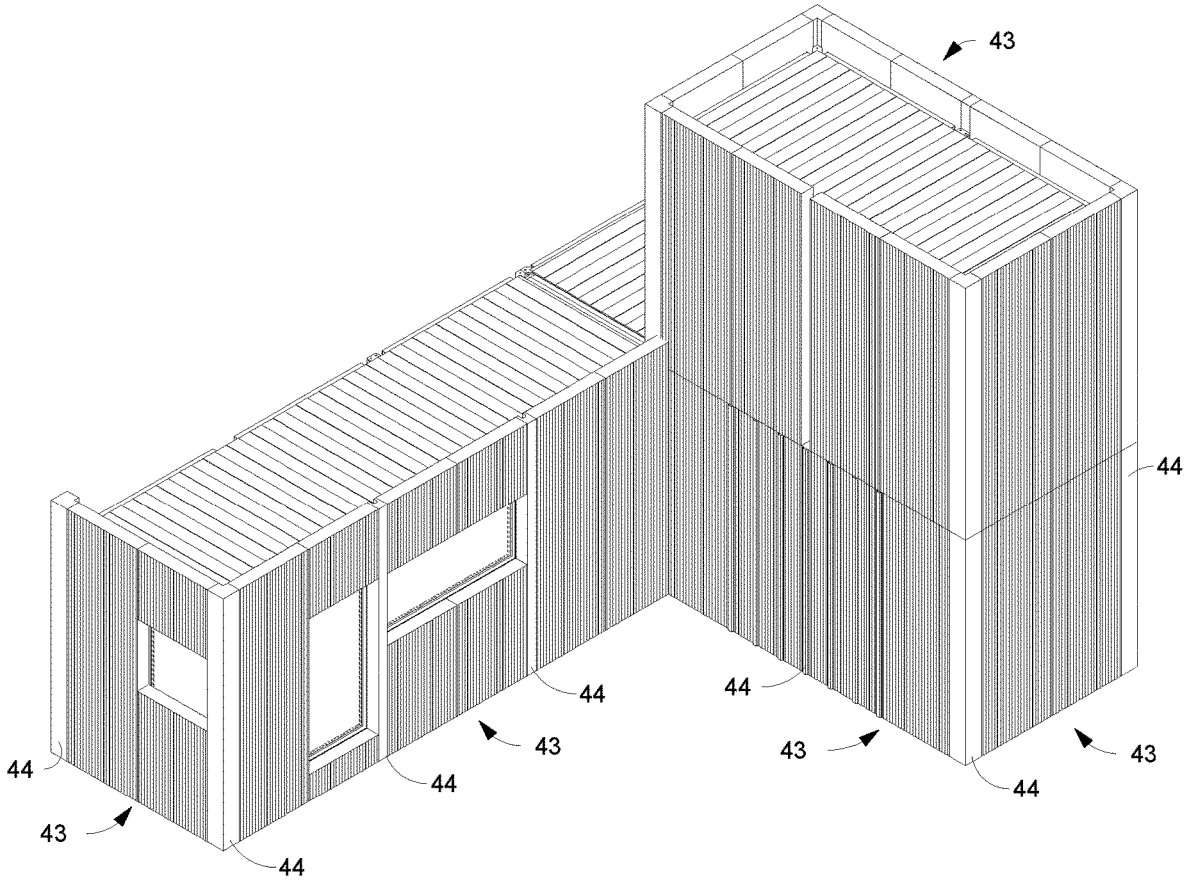
FIG. 31: Insulation panel units—isometric view—shows thermal insulation panels placed on the outer faces of exterior wall units, as well as rain drains where applicable.
Figure 32:
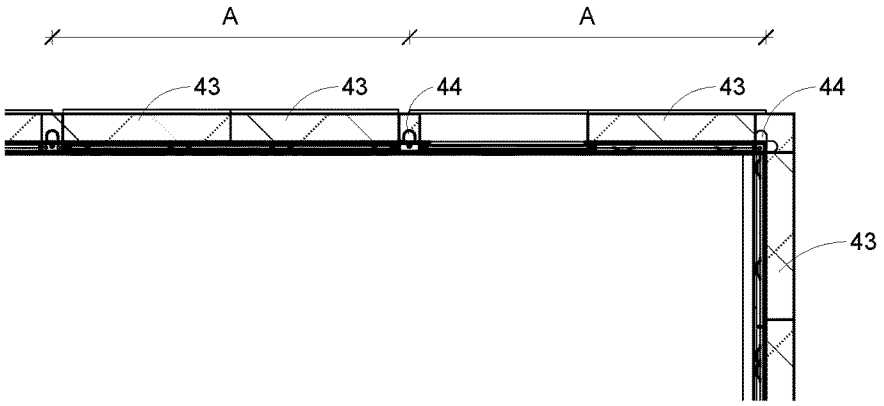
FIG. 32: Insulation panel units—plan view—shows thermal insulation panels and illustrates further spaces for rain drains where needed or fill units where they are not.

Turning to FIG. 31 and FIG. 32 (top sectional view), with additional details illustrated in FIG. 16, there is shown how a set of thermal insulation panel units can be provided in the system. The thermal insulation panel units (43) are mounted on the outside of the exterior wall units and attached with bolts to the building module, for example to upper lateral attachment steel angles (30); lateral attachment steel tubes (32); and lower lateral attachment steel plate (35). At the vertical edges of the thermal insulation units which coincide with the attachment points, a space is left for drainage pipes (44) for rainwater from roof areas. The drainage pipes will be concealed behind exterior cladding. Where drainage pipes are not needed, correctly sized insulation fill material is provided to fill the space.

Figure 33:
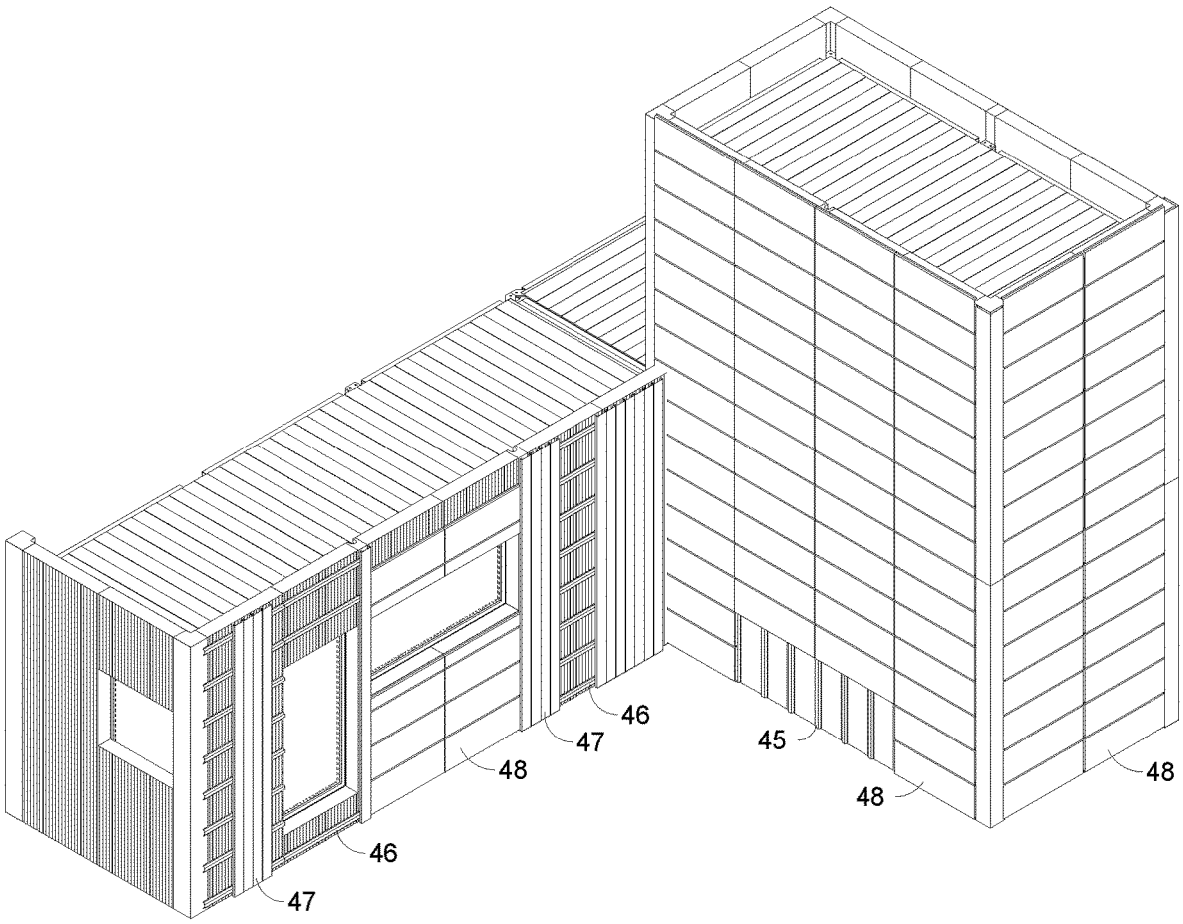
FIG. 33: Exterior cladding units—shows exterior cladding units on building units as well as horizontal and vertical rails behind for their attachment.

Exterior cladding for protection against wind, precipitation and sunshine can also be provided. The exterior cladding (FIG. 33) is preferably made of, but is not limited to, metal panels which can be either arranged vertically (47) with horizontal attachment rails (46), or horizontally (48) with vertical attachment rails (45).

Figure 34:
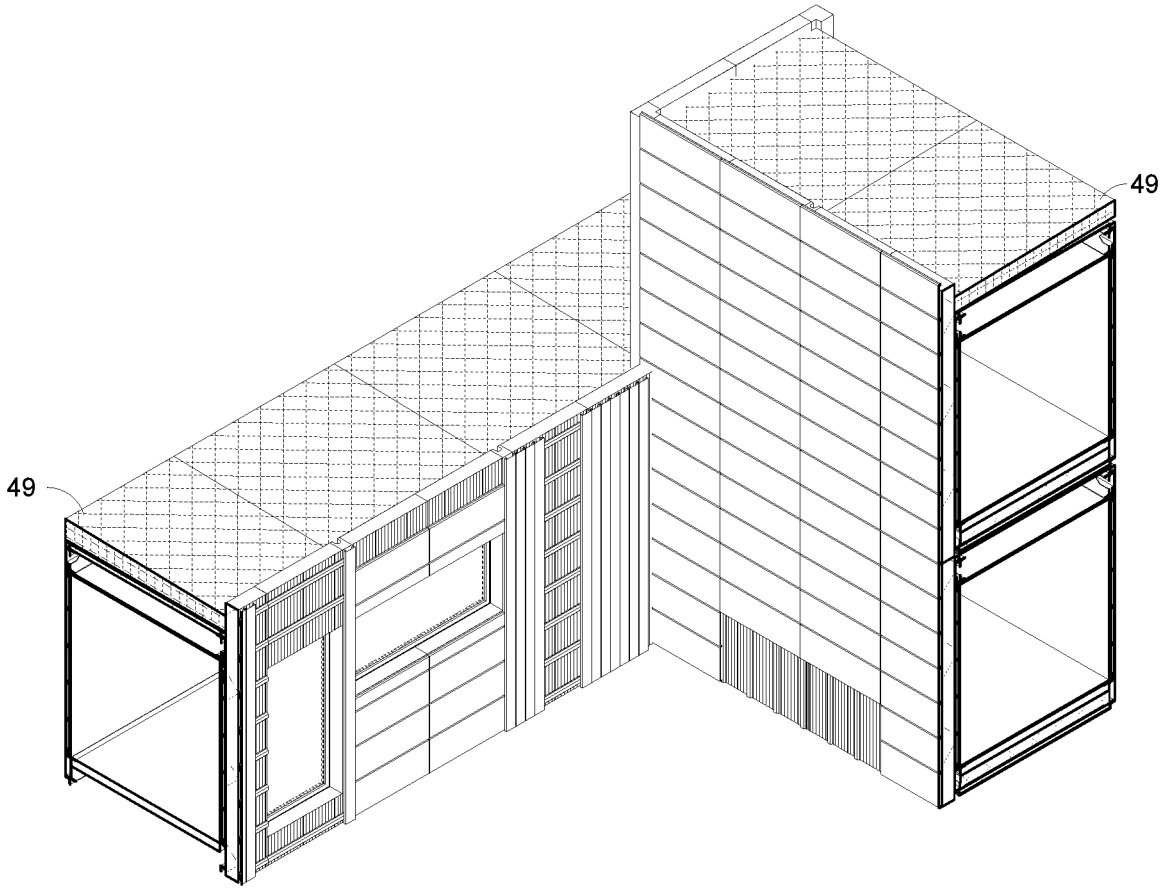
FIG. 34: Roof insulation units—shows thermal insulation units to be placed on top of uppermost building modules of buildings.
Figure 35:
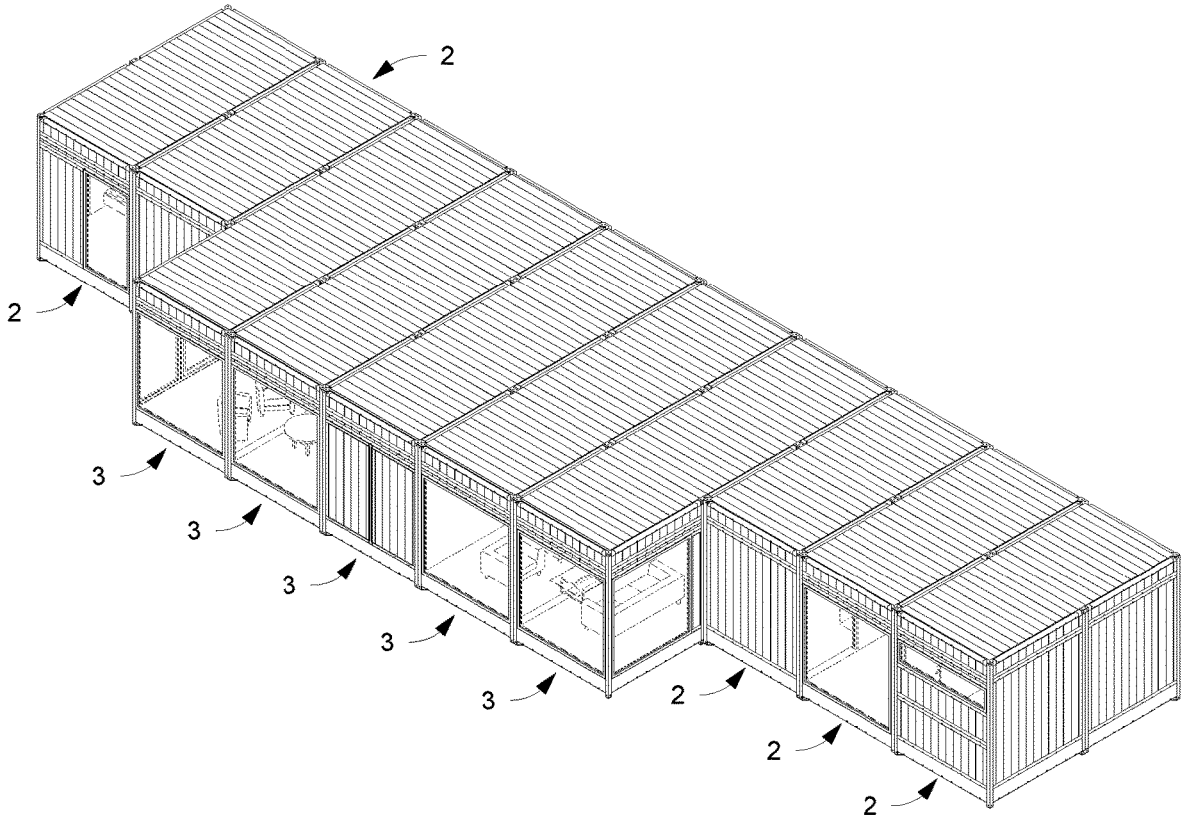
FIG. 35: Shows a building example 1, Bird's eye view.
Figure 36:
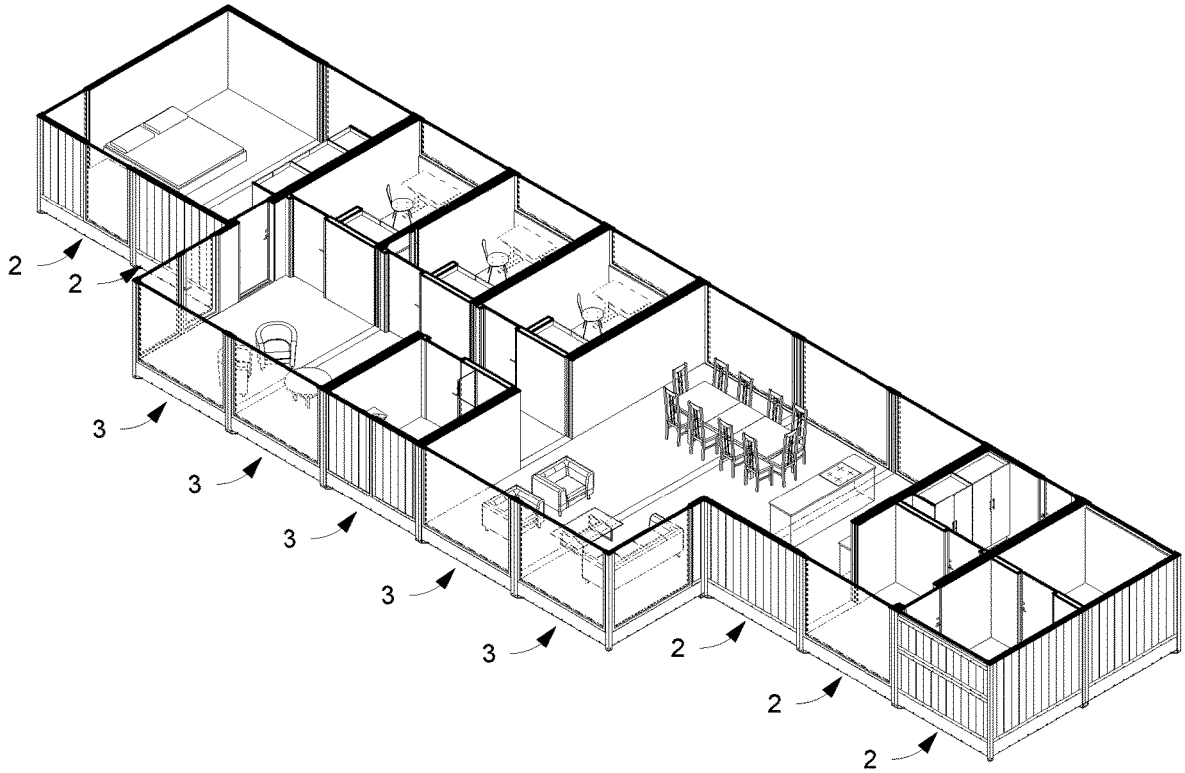
FIG. 36: Shows a building example 1, Interior layout.
Figure 37:
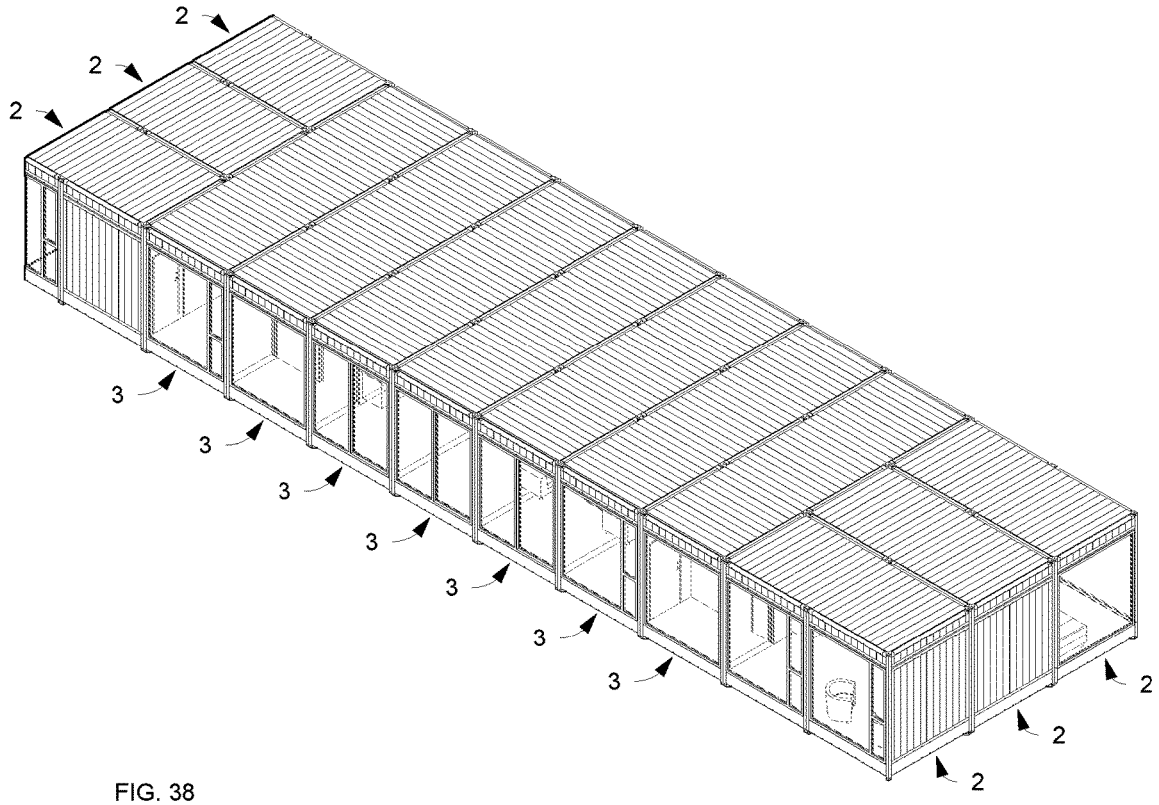
FIG. 37: Shows a building example 2, Bird's eye view.
Figure 38:
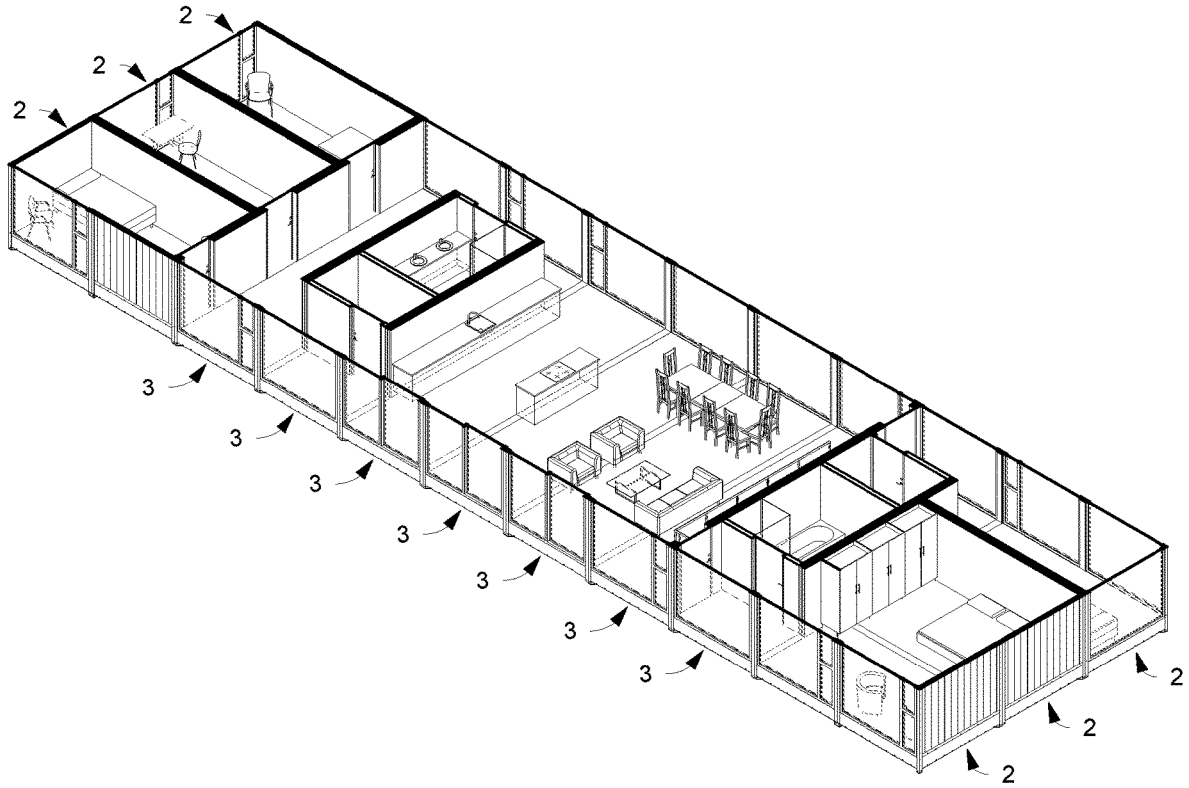
FIG. 38: Shows a building example 2, Interior layout.

The modular building assembly can be provided with suitable roof units. The roof units are designed to be placed on top of the uppermost building modules, comprising but not limited to sloped roof insulation units (49), i.e. roof units that have internal insulation. The insulation will be covered with a watertight roof membrane and rainwater flow will be directed towards roof drains. FIG. 34 shows an example of roof insulation units (49) on top of building modules.

Roof units are preferably of modular design, i.e. their dimensions correspond to the dimensions of the unit cell (length and width) or a multiple thereof. In general, the width of the roof units can correspond to the width of the unit cell, and the length of the roof unit can be an integer value of the length of the unit cell.

The roof units can be connected to the building construct via connection points on the building modules, preferably connection points at the connection nodes of the building modules.

Other types of roof units that are not necessarily modular can also be used with the modular building design, if so desired. It can however be desirable, for such construction, to make use of the connection nodes of the modular building, i.e. make use of connection points that are provided at the connection nodes.

The building modules can be installed with interior walls. Such interior walls can be prefabricated or the walls can be constructed on site. In some embodiments a set of prefabricated interior wall units is provided and can be installed within the building structures according to an area plan. Door units can be placed in between interior wall units. The range of interior wall units can include units of different fire resistance ratings, which facilitates the fire compartmentalization of buildings constructed from units of the Architectural Modular Building System. Instead of using prefabricated interior wall units it is also quite possible to build interior walls on site according to local building custom using locally procured materials and labour.

The physical dimensions of the building modules allow transport of the individual modules by e.g. trucks. In most countries both the width, height and length of a truck with load, as well as axle loads are limited. The modules M1, M2 and M3 can be loaded on a low bed semi-trailer and trucked to any destination reachable by roads of sufficient quality. This facilitates the transport from manufacturer to buyer and from one site to another without additional measures. The transportability of the building modules increases their usability. They can be transported and erected by the owner in a new location or they can be sold to a new owner. The creation of an aftermarket in used modules is an important factor in retaining their monetary value.

Exemplary building designs using the building modules as disclosed herein are shown on FIG. 35-FIG. 38. As can be seen in these examples, highly functional and variable buildings can be constructed using the modular building modules, which can be assembled in any desired configuration (e.g., end-on, in parallel, orthogonally, and vertically). Shown are two examples of building assemblies, with the first example being shown in FIG. 35 and FIG. 36 (interior view) and the second example in FIG. 37 and FIG. 38 (interior view). In these examples it is shown that the simple modular building module system can be used to assemble complex building structures from two types of building modules—M2 and M3, containing respectively two unit cells and three unit cells each.

Various exterior wall units are provided, to accommodate windows and doors, interior walls are provided within some individual building modules and large open spaces generated by two or more adjacent open building modules.

As used herein, including in the claims, singular forms of terms are to be construed as also including the plural form and vice versa, unless the context indicates otherwise. Thus, it should be noted that as used herein, the singular forms "a" "an," and "the" include plural references unless the context clearly dictates otherwise.

Throughout the description and claims, the terms "comprise", "including", "having", and "contain" and their variations should be understood as meaning "including hut not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

In the following table, a list of numerical items on the accompanying drawings is provided.

List of items indexed on drawings

| Item no. | Item name | Shown in FIGS. no. |
|---|---|---|
| 1 | Building module M1 | 1, 4, 5, 8 |
| 2 | Building module M2 | 2, 4, 5, 6, 9, 35, 36, 37, 38 |
| 3 | Building module M3 | 3, 4, 5, 7, 10, 35, 36, 37, 38 |
| 4 | Connection point, upper - corner | 8, 9, 10 |
| 5 | Connection point, upper - middle | 9, 10 |
| 6 | Connection point, lower - middle | 9, 10 |
| 7 | Connection point, lower - corner | 8, 9, 10 |
| 8 | Steel plate, corner - top/bottom | 11, 12, 15, 16, 17 |
| 9 | Steel column connection hole, corner - side | 11, 12, 15, 16 |
| 10 | Steel plate, middle - top/bottom | 13, 14, 15, 23, 24 |
| 11 | Steel plate, middle - side | 13, 14, 15, 19 |
| 12 | Lateral corner connection -top/bottom | 17, 18 |
| 13 | Lateral side connection - top/bottom | 19, 20 |
| 14 | Vertical corner connection | 21, 22 |
| 15 | Vertical side connection | 23, 24 |
| 16 | Installation pathways | 15, 16, 20, 26 |
| 17 | Corrugated steel deck | 15, 16, 20 |
| 18 | Concrete deck | 16, 20 |
| 19 | Insulation | 16, 20 |
| 20 | Bottom steel cladding | 16, 19, 20 |
| 21 | Optional floor finish | 17, 19, 20 |
| 22 | Secondary load bearing system of top face | 15, 16, 20 |
| 23 | Top steel cladding | 16, 20 |
| 24 | Horizontal I shaped beams | 13, 12, 15, 16, 17, 19, 20 |
| 25 | Corner steel column | 11, 12, 15, 17 |
| 26 | Side steel column | 13, 15 |
| 27 | Optional suspended ceiling | 16, 17, 20 |
| 28 | Lower lateral edge steel angle | 16, 17, 19 |
| 29 | Upper lateral edge steel angle | 11, 16, 17, 19 |
| 30 | Upper lateral edge attachment steel angle | 11, 16, 19, 21 |
| 31 | Steel plate panel | 16 |
| 32 | Lateral attachment steel tube | 16 |
| 34 | Wall stiffening angle | 16 |
| 35 | Lateral lower attachment steel plate | 16 |
| 36 | Prefabricated foundation element | 25 |
| 37 | Stairway module, ground floor | 29 |
| 38 | Stairway module intermediate floor | 28 |
| 39 | Stairway module, top floor | 27 |
| 40 | Exterior wall unit with variable sized window | 30 |

-continued

List of items indexed on drawings

| Item no. | Item name | Shown in FIGS. no. |
|---|---|---|
| 41 | Exterior wall unit with variable sized door | 30 |
| 42 | Exterior wall unit | 30 |
| 43 | Insulation panel unit | 31, 32 |
| 44 | Fill or raindrain in insulation panel unit | 31, 32 |
| 45 | Vertical rail | 33 |
| 46 | Lateral rail | 33 |
| 47 | Vertical cladding | 33 |
| 48 | Lateral cladding | 33 |
| 49 | Roof insulation units with slope | 34 |
| 50 | Roof panel | 17 |
| 51 | Wall panel | 19 |

The invention claimed is:

1. A building module having four sides, a length, width and height, the building module comprising:

a frame having a length of two or more unit cells, wherein each unit cell of the two or more unit cells is defined as a rectangular parallelepiped structure with an equal length and width;

the frame having four upright load bearing corner columns and load bearing beams positioned at, or near, upper and lower ends of each of the load bearing corner columns to connect adjacent said load bearing corner columns in the frame and thereby define four rectangular parallelograms at each said side of the building module, wherein said four parallelograms comprise a first pair of lengthwise parallelograms being parallel and a second pair of parallelograms being parallel and orthogonal to said first pair, wherein the load bearing beams of said load bearing beams that form the lengthwise parallelograms have a length which equals the length of the frame and said length is an integer multiple of the width of the frame, wherein said integer is two to five;

a plurality of connection nodes, the connection nodes being positioned on the frame at positions corresponding to corners of the two or more unit cells within the frame, the connection nodes being adapted for selective, disconnectable connection to connection nodes on adjacent building modules in an assembly of building modules;

wherein the building module is connectable to at least one further building module, by allowing connection nodes of at least one unit cell of the building module to engage connection nodes of at least one unit cell on the at least one further building module, thereby allowing side-by-side, end-to-end and end-to-side connection of said building modules so that connection nodes on said building module are aligned with connection nodes on said at least one further building module;

wherein said load bearing corner columns are connected by said load-bearing beams that are connected to the load bearing corner columns at, or near, upper and lower corners of the building module to define load bearing upper beams and load bearing lower beams of said load-bearing beams, so that said load bearing upper beams define a first horizontal plane, and said load bearing lower beams define a second plane, parallel to the first plane;

wherein said load-bearing beams comprise apertures thereon that are positioned symmetrically on the load-bearing beams within each unit cell, so that an aperture on a first load-bearing beam is positioned directly opposite to and aligned with an aperture on a second oppositely located load-bearing beam within the building module; and wherein said apertures are provided so that, when said building module is placed adjacent and aligned with a second building module, apertures on said building module that come in contact with the second building module are aligned with apertures on said second building module, thereby allowing side-by-side, end-to-end and end-to-side connection of said building modules so that apertures on said building module are aligned with apertures on said second building module.

2. The building module of claim 1, wherein the load-bearing beams are adapted to receive floor and ceiling loads, respectively.

3. The building module of claim 1, further comprising one or more of internal and/or external wall panels that are connected to the frame.

4. The building module of claim 1, wherein said width of the building module is in a range of 2400 mm to 2700 mm.

5. The building module of claim 1, wherein said height of the building module is in a range of 2800 mm to 4000 mm.

6. A modular building assembly, comprising two or more prefabricated interconnected building modules according to claim 1, wherein adjacent building modules in the building assembly are aligned and interconnected in tandem, orthogonally or vertically, so that at least one unit cell in a first building module is interconnected and aligned with a unit cell in an adjacent second building module.

7. The modular building assembly of claim 6, further comprising a modular roof unit, wherein the modular roof unit is adapted for connection to connection nodes in the modular building assembly.

8. The modular building assembly of claim 6, further comprising a support foundation, for providing ground support for the modular building assembly.

9. A system for construction of a building assembly, the system comprising:

a plurality of interconnectable building modules, wherein each building module of said plurality of interconnectable building modules has a length, a width and a height, and comprises a frame having a length of two or more unit cells wherein each unit cell is defined as a rectangular parallelepiped structure with an equal length and width;

the frame having four upright load bearing corner columns and load bearing beams positioned at, or near, upper and lower ends of each of the load bearing corner columns to connect adjacent said load bearing corner columns in the frame and thereby define four rectangular parallelograms at each said side of the building module, wherein said four parallelograms comprise a first pair of lengthwise parallelograms being parallel and a second pair of parallelograms being parallel and orthogonal to said first pair, wherein the load bearing beams of said load bearing beams that form the lengthwise parallelograms have a length which equals the length of the frame and said length is an integer multiple of the width of the frame, wherein said integer is two to five;

wherein the length of each building module of said plurality of interconnectable building modules and the length of the respective frame of each building module is independently an integer multiple of the width of the frame;

wherein each building module of said plurality of interconnectable building modules further comprises a plurality of connection nodes, the connection nodes being positioned on the frame of each building module at positions corresponding to corners of the two or more unit cells within the frame so that connection nodes of a first building module of the plurality of interconnectable building modules are adapted to connection nodes of an adjacent and aligned second building module of the plurality of interchangeable building modules in said building assembly, thereby allowing side-by-side, end-to-end and end-to-side connection of building modules of the plurality of interconnectable building modules so that connection nodes on said first building module are aligned with connection nodes on said second building module;

wherein said load-bearing beams of each said building module of the plurality of interconnectable building modules comprise apertures thereon that are positioned symmetrically on the load-bearing beams within each unit cell of said building module, so that an aperture on a first load-bearing beam is positioned directly opposite to and aligned with an aperture on a second oppositely located load-bearing beam within the building module, and wherein said apertures are provided so that, when the first building module of the plurality of interconnectable building modules is placed adjacent and aligned with the second building module of the plurality of interconnectable building modules, apertures within said first building module that come in contact with the second building module are aligned with apertures on the second building module, thereby allowing side-by-side, end-to-end and end-to-side connection of building modules of the plurality of interconnectable building modules so that apertures on said first building module are aligned with apertures on said second building module.

10. The system of claim 9, comprising:

a plurality of connectors that are adapted to engage adjacent connection nodes in adjacent building modules of said plurality of interconnectable building modules in said building assembly so that said adjacent building modules in said building assembly can be securely disconnectably connected.

* * * * *